US012473927B2

(12) United States Patent
Numata

(10) Patent No.: US 12,473,927 B2
(45) Date of Patent: Nov. 18, 2025

(54) BLOWER

(71) Applicant: MAKITA CORPORATION, Anjo (JP)

(72) Inventor: Fumitoshi Numata, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 18/749,034

(22) Filed: Jun. 20, 2024

(65) Prior Publication Data

US 2024/0337271 A1 Oct. 10, 2024

Related U.S. Application Data

(63) Continuation of application No. 18/368,847, filed on Sep. 15, 2023, now Pat. No. 12,055,158, which is a (Continued)

(30) Foreign Application Priority Data

Dec. 23, 2020 (JP) ..... 2020-214180
Dec. 23, 2020 (JP) ..... 2020-214182
Dec. 23, 2020 (JP) ..... 2020-214184

(51) Int. Cl.
*F04D 29/42* (2006.01)
*F04D 17/16* (2006.01)
*F04D 25/08* (2006.01)

(52) U.S. Cl.
CPC ..... *F04D 29/4253* (2013.01); *F04D 17/165* (2013.01); *F04D 25/086* (2013.01)

(58) Field of Classification Search
CPC ..... A47L 2501/12; A45D 20/10; A45D 20/12; F04D 17/165; F04D 25/086
See application file for complete search history.

(56) References Cited

U.S. PATENT DOCUMENTS 4,135,080 A 1/1979 Wells, Jr.
4,972,065 A 11/1990 Ohlsen
(Continued)

FOREIGN PATENT DOCUMENTS

CN 211633061 U 10/2020
JP S62-246309 A 10/1987
(Continued)

OTHER PUBLICATIONS

KR 102477154 Reference with machine translation (Year: 2020).*
(Continued)

*Primary Examiner* — Brian O Peters
(74) *Attorney, Agent, or Firm* — Oliff PLC

(57) ABSTRACT

A blower includes a body, a motor, and a single fan configured to rotate in response to rotation of a motor shaft to discharge air through a discharge opening. The maximum rotational speed of the motor shaft is within a range of 50,000 rpm to 120,000 rpm. An area of the discharge opening is changeable by a user. The blower is configured to selectively operate in a first mode or in a second mode according to the area of the discharge opening. In the first mode, the maximum blowing force of the air discharged through the opening is within a range of 2.5 N to 5.0 N when the motor is driven at the maximum rotational speed. In the second mode, the maximum dynamic pressure of the air discharged is within a range of 30 kPa to 65 kPa when the motor is driven at the maximum rotational speed.

11 Claims, 10 Drawing Sheets

Related U.S. Application Data continuation of application No. 17/556,185, filed on Dec. 20, 2021, now Pat. No. 11,795,967.

(56) References Cited

U.S. PATENT DOCUMENTS

| | | | |
|---|---|---|---|
| 6,101,670 | A | 8/2000 | Song |
| 10,905,585 | B1 | 2/2021 | Sabin |
| 2008/0304986 | A1 | 12/2008 | Kenyon et al. |
| 2009/0246013 | A1 | 10/2009 | Kenyon et al. |
| 2014/0050600 | A1 | 2/2014 | Kodato et al. |
| 2014/0140861 | A1 | 5/2014 | Pellenc |
| 2014/0147252 | A1 | 5/2014 | Takano |
| 2015/0366424 | A1 | 12/2015 | Naka et al. |
| 2016/0213123 | A1 | 7/2016 | Sakuma et al. |
| 2016/0238026 | A1 | 8/2016 | Barclay |
| 2016/0324292 | A1 | 11/2016 | Depoyian |
| 2018/0172024 | A1 | 6/2018 | Hayamitsu et al. |
| 2018/0187687 | A1 | 7/2018 | Yakubova et al. |
| 2018/0216635 | A1 | 8/2018 | Hayamitsu |
| 2018/0266438 | A1 | 9/2018 | Hayamitsu |
| 2020/0137966 | A1 | 5/2020 | Suzuki |
| 2020/0214229 | A1 | 7/2020 | Yamaoka et al. |
| 2020/0378404 | A1 | 12/2020 | Fukunaga |
| 2021/0270291 | A1 | 9/2021 | Ichihashi |
| 2021/0289908 | A1 | 9/2021 | Lo |
| 2021/0340991 | A1 | 11/2021 | Ojima et al. |
| 2022/0032439 | A1 | 2/2022 | Numata |
| 2022/0183241 | A1 | 6/2022 | Liu et al. |
| 2022/0196035 | A1 | 6/2022 | Numata et al. |
| 2022/0305508 | A1 | 9/2022 | Numata |

FOREIGN PATENT DOCUMENTS

| | | | |
|---|---|---|---|
| JP | S63-59184 | U | 4/1988 |
| JP | H11-336696 | A | 12/1999 |
| JP | 2000-120599 | A | 4/2000 |
| JP | 2002-310098 | A | 10/2002 |
| JP | 2008-303876 | A | 12/2008 |
| JP | 2009-537735 | A | 10/2009 |
| JP | 2010-185289 | A | 8/2010 |
| JP | 2011050506 | A | 3/2011 |
| JP | 2011-117442 | A | 6/2011 |
| JP | 2013-019277 | A | 1/2013 |
| JP | 2014-37817 | A | 2/2014 |
| JP | 2014-511953 | A | 5/2014 |
| JP | 2015-34514 | A | 2/2015 |
| JP | 2015-109935 | A | 6/2015 |
| JP | 2016-123398 | A | 7/2016 |
| JP | 2016-148342 | A | 8/2016 |
| JP | 2017-070337 | A | 4/2017 |
| JP | 2017-129111 | A | 7/2017 |
| JP | 2017-211105 | A | 11/2017 |
| JP | 2018-84151 | A | 5/2018 |
| JP | 2018-123738 | A | 8/2018 |
| JP | 2018-155238 | A | 10/2018 |
| JP | 2020-76355 | A | 5/2020 |
| JP | 2020-133426 | A | 8/2020 |
| JP | 2020133425 | A | 8/2020 |
| JP | 2020-139453 | A | 9/2020 |
| JP | 2020-193580 | A | 12/2020 |
| KR | 1020190142279 | * | 10/2019 |
| KR | 102477154 | * | 12/2020 |
| WO | 2011052560 | A1 | 5/2011 |
| WO | 2016/194254 | A1 | 12/2016 |
| WO | 2018028639 | A1 | 2/2018 |
| WO | 2018/061555 | A1 | 4/2018 |
| WO | 2018/185950 | A1 | 10/2018 |
| WO | 2019/223438 | A1 | 11/2019 |
| WO | 2021/106493 | A1 | 6/2021 |

OTHER PUBLICATIONS

KR 20190142279 Reference with machine translation (Year: 2019).*
Aug. 6, 2024 Office Action issued in Japanese Patent Application No. 2020-214188.
Aug. 6, 2024 Office Action issued in Japanese Patent Application No. 2022-179628.
Aug. 6, 2024 Office Action issued in Japanese Patent Application No. 2022-179809.
Dec. 6, 2022 Office Action issued in Japanese Patent Application No. 2020-214190.
Apr. 4, 2023 Office Action issued in Japanese Patent Application No. 2020-214190.
Jul. 4, 2023 Office Action issued in Japanese Patent Application No. 2020-214190.
Nov. 30, 2022 Office Action issued in Japanese Patent Application No. 2020-214182.
Dec. 7, 2022 Office Action issued in U.S. Appl. No. 17/556,185.
Mar. 28, 2023 Office Action issued in U.S. Appl. No. 17/556,185.
U.S. Appl. No. 18/368,847, filed Sep. 15, 2023 in the name of Numata.
U.S. Appl. No. 17/556,185 filed Dec. 20, 2021 in the name of Numata.
Mar. 12, 2024 Office Action issued in Japanese Patent Application No. 2020-214188.
Mar. 12, 2024 Office Action issued in Japanese Patent Application No. 2020-214184.
Feb. 27, 2024 Office Action issued in Japanese Patent Application No. 2022-179628.
Feb. 27, 2024 Office Action issued in Japanese Patent Application No. 2022-179809.
Mar. 12, 2024 Office Action issued in Japanese Patent Application No. 2020-214180.
May 21, 2024 Notice of Allowance received in U.S. Appl. No. 18/368,847.
U.S. Appl. No. 18/370,569, filed Sep. 20, 2023 in the name of Numata et al.
Mar. 13, 2025 Office Action issued in U.S. Appl. No. 18/370,569.
Mar. 24, 2025 Office Action issed in Japanese Patent Application No. 2022-179628.
Mar. 24, 2025 Decision of Dismissal of Amendment issued in Japanese Patent Application No. 2022-179628.
Jul. 29, 2025 Office Action issued in Chinese Patent Application No. 202111579143.9.

* cited by examiner

BLOWER

CROSS-REFERENCE TO RELATED APPLICATION

This is a Continuation application of U.S. patent application Ser. No. 18/368,874 filed Sep. 15, 2023, which is a Continuation of U.S. patent application Ser. No. 17/556,185 filed Dec. 20, 2021, which in turn claims priority to Japanese Patent Application Nos. 2020-214180, 2020-214182, and 2020-214184, all of which were filed on Dec. 23, 2020. The contents of the foregoing applications are hereby fully incorporated herein by reference.

TECHNICAL FIELD

The present disclosure relates to an electric blower.

BACKGROUND

A known electric blower is capable of blowing off grit, dust, etc. by discharging air through a discharging opening. For example, Japanese Unexamined Patent Application Publication No. 2011-117442 discloses a blower (a so-called air duster) that is configured to generate compressed air using centrifugal fans rotated by a motor and to discharge the generated compressed air through a nozzle.

SUMMARY

The above-described blower is a so-called multiple-stage centrifugal blower in which the centrifugal fans are aligned in an extension direction of a rotational axis of the fans. Such a blower is apt to be large in the extension direction of the rotational axis.

Accordingly, one, non-limiting object of the present disclosure is to provide a blower that is relatively small and that is superior in usability.

One aspect of the present disclosure provides a blower that is configured to discharge air through a discharge opening. The blower includes a body, a motor and a single fan. The motor is housed in the body. The motor includes a motor body, which includes a stator and a rotor, and a motor shaft, which is configured to rotate integrally with the rotor. The fan is housed in the body. The fan is configured to rotate in response to rotation of the motor shaft to discharge air through the discharge opening. The "single fan" herein means that the number of fans for discharging the air through the discharge opening is only one. Thus, the "single fan" herein does not exclude a configuration in which a fan for cooling the motor or other component(s) is additionally provided.

The maximum rotational speed of the motor shaft is within a range of 50,000 rpm to 120,000 rpm. In a case in which the rotational speed of the motor can be changed steplessly or in multiple steps, it is sufficient that the maximum rotational speed within its settable range is within the above-described range of the maximum rotational speed of the motor.

The blower is configured such that an area of the discharge opening is changeable by a user. Further, the blower is configured to selectively operate in a first mode or in a second mode, according to the area of the discharge opening. In the first mode, the maximum blowing force of the air discharged through the discharge opening is within a range of 2.5 newtons (N) to 5.0 N when the motor is driven at the maximum rotational speed. In the second mode, the maximum dynamic pressure of the air discharged through the discharge opening is within a range of 30 kilopascals (kPa) to 65 kPa when the motor is driven at the maximum rotational speed.

In the blower of this aspect, only one fan is employed for discharging air, while a relatively high-speed motor is employed. Accordingly, compared to a multiple-stage blower having a plurality of fans, the body can be downsized in an extension direction of a rotational axis of the fan while relatively large blowing force can be achieved. High pressure of the discharged air may be sometimes more required than the magnitude (strength) of the blowing force of the discharged air, depending on a desired operation to be performed using the blower. The blower of this aspect can selectively operate, depending on the area of the discharge opening, in the first mode that achieves a relatively large maximum blowing force or in the second mode that achieves relatively high maximum dynamic pressure. Thus, the user can use the blower in an appropriate action mode by changing the area of the discharge opening depending on the kind of the desired operation, and thus the usability of the blower can be improved.

DETAILED DESCRIPTION OF THE EMBODIMENTS

Figure 1:
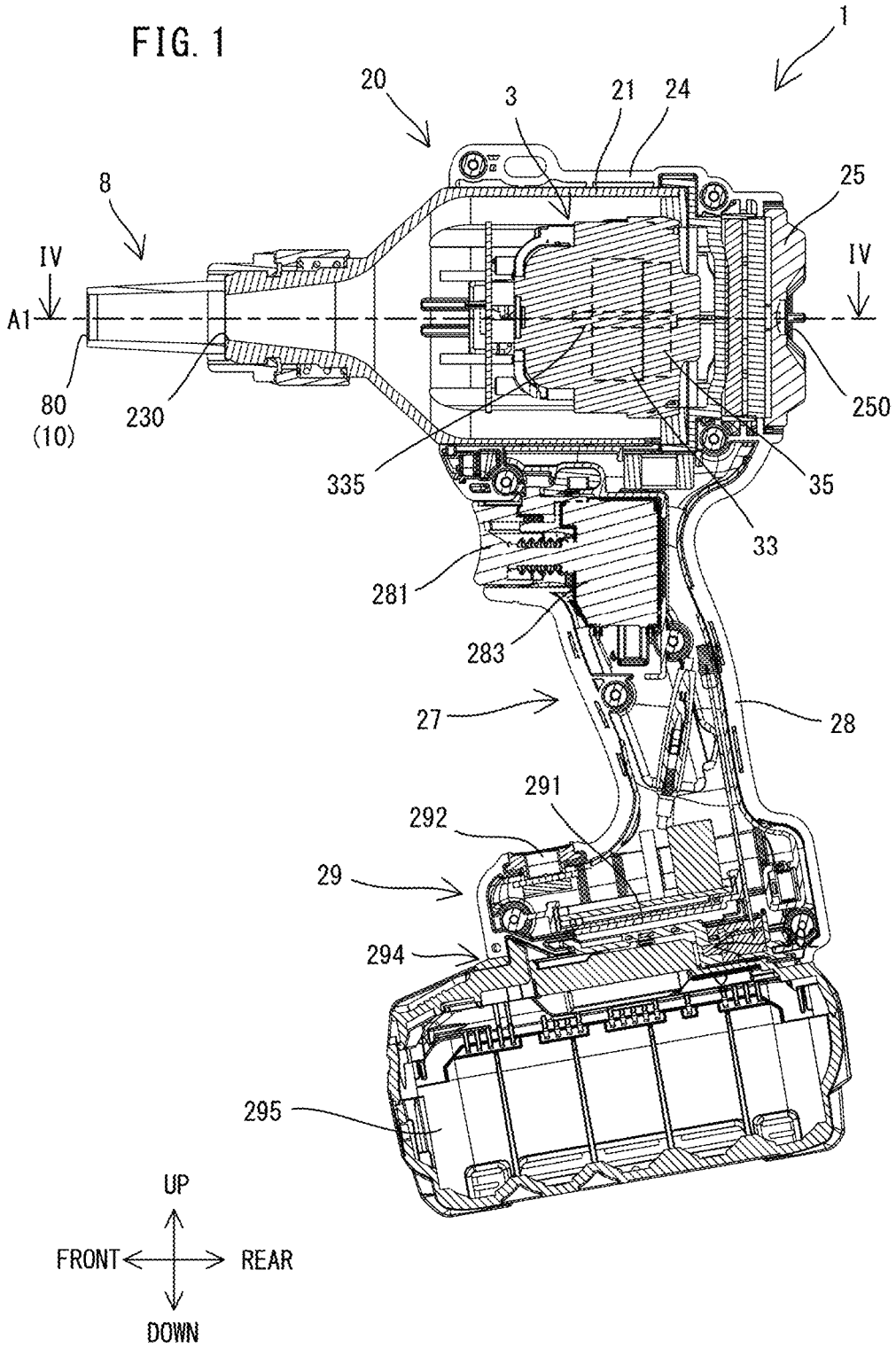
FIG. 1 is a sectional view of an air duster.

In one non-limiting embodiment according to the present disclosure, the area of the discharge opening may be changeable within a range of an area of a circle having a diameter of 6 mm to an area of a circle having a diameter of 15 mm. It is noted that, although the area of the discharge opening is herein defined by the area of the circle, which is a typical shape of the discharge opening, the discharge opening need not necessarily have a circular shape. The discharge opening may have another shape as long as the area of the discharge opening is within the above-described range. In a case in which the discharge opening has a circular shape, the above-described feature may be also rephrased as "the diameter of the discharge opening is within a range of 6 mm to 15 mm". This embodiment defines a rational range of the area of the discharge opening that enables the first mode and the second mode while reducing the possibility of surge.

In addition or in the alternative to the preceding embodiment, the body may be configured such that a nozzle, which is selected from a plurality of nozzles respectively having openings with different areas, is removably mountable thereon. Further, the area of the discharge opening may be changeable at least in response to replacement of the nozzle. According to this embodiment, a user can easily change the area of the discharge opening by replacing the nozzle.

In addition or in the alternative to the preceding embodiments, the diameter of the fan may be within a range of 40 mm to 45 mm. According to this embodiment, by utilizing the fan having a relatively small diameter, a size increase of the body in a radial direction of the fan can be suppressed.

In addition or in the alternative to the preceding embodiments, the maximum rotational speed of the motor shaft may be within a range of 70,000 rpm to 90,000 rpm. The maximum blowing force in the first mode may be within a range of 3.0 N to 4.0 N. The maximum dynamic pressure in the second mode may be within range of 35 kPa to 50 kPa. According to this embodiment, the blower can be realized that generates a relatively large maximum blowing force in the first mode and relatively high maximum dynamic pressure in the second mode, utilizing the fan having the maximum rotational speed within a rational range.

In addition or in the alternative to the preceding embodiments, the blower may be configured to operate in the first mode when the area of the discharge opening is within a range of an area of a circle having a diameter of 12 mm to an area of a circle having a diameter of 15 mm. The blower may also be configured to operate in the second mode when the area of the discharge opening is within a range of an area of a circle having a diameter of 6 mm to an area of a circle having a diameter of 8 mm. As described above, the discharge opening need not necessarily have a circular shape. In a case in which the discharge opening has a circular shape, the above-described feature may be also rephrased as "the blower may be configured to operate in the first mode when the diameter of the discharge opening is within a range of 12 mm to 15 mm, and the blower may be configured to operate in the second mode when the diameter of the discharge opening is within a range of 6 mm to 8 mm". This embodiment provides rational ranges of the area of the discharge opening for realizing the first mode and the second mode, respectively.

In addition or in the alternative to the preceding embodiments, the blower may further comprise a circuit board that is electrically connected to the motor body. The fan may be arranged between an inlet opening of the body and the motor body in an axial direction of the motor shaft. The circuit board may also be arranged between the motor body and the discharge opening in the axial direction of the motor shaft. According to this embodiment, the motor body and the circuit board can be cooled by the air delivered by the fan and flowing toward the discharge opening.

In addition or in the alternative to the preceding embodiments, the motor and the fan may be housed in a case. The motor, the fan, the case, and the circuit may together form an integral motor assembly. The circuit board may be arranged between the case and the discharge opening. A space may be defined between the motor assembly and an inner surface of the body in a radial direction of the motor. According to this embodiment, even though the circuit board is arranged between the case and the discharge opening, the air blown out of the case can flow toward the discharge opening through the space between the motor assembly and the inner surface of the body.

In addition or in the alternative to the preceding embodiments, the rotational speed of the motor shaft may be changeable. According to this embodiment, the blowing force of the air discharged through the discharge opening can be changed by not only the change in the area of the discharge opening but also the change in the rotational speed, and thus the usability can be further improved. The rotational speed may be changed typically in response to an external manipulation of the manipulation part (for example, a push button, a trigger, a dial, a touch panel, etc.) performed by the user.

In addition or in the alternative to the preceding embodiments, the blower may further comprise a trigger configured to be manually depressed by a user. The rotational speed of the motor shaft may be changed according to a depressed amount of the trigger. According to this embodiment, a user can appropriately change the rotational speed by depressing the trigger to thereby adjust the blowing force.

An air duster 1 according to one non-limiting embodiment is now described in detail with reference to the drawings. It is noted that, in FIGS. 1, 2 and 4, which are sectional views, a motor assembly 3 is simply schematically illustrated as one unit.

The air duster 1 is an example of an electric blower. More specifically, the air duster 1 is a kind of electric blower that is capable of blowing off grit, dust, etc., by discharging compressed air through a discharge opening 10. The air duster 1 is configured as a handheld electric tool to be used while held by a user.

As shown in FIG. 1, an outer shell of the air duster 1 is mainly formed by a body 20 that houses a motor 33 and a fan 35, and a handle 27 configured to be held by a user.

Figure 3:
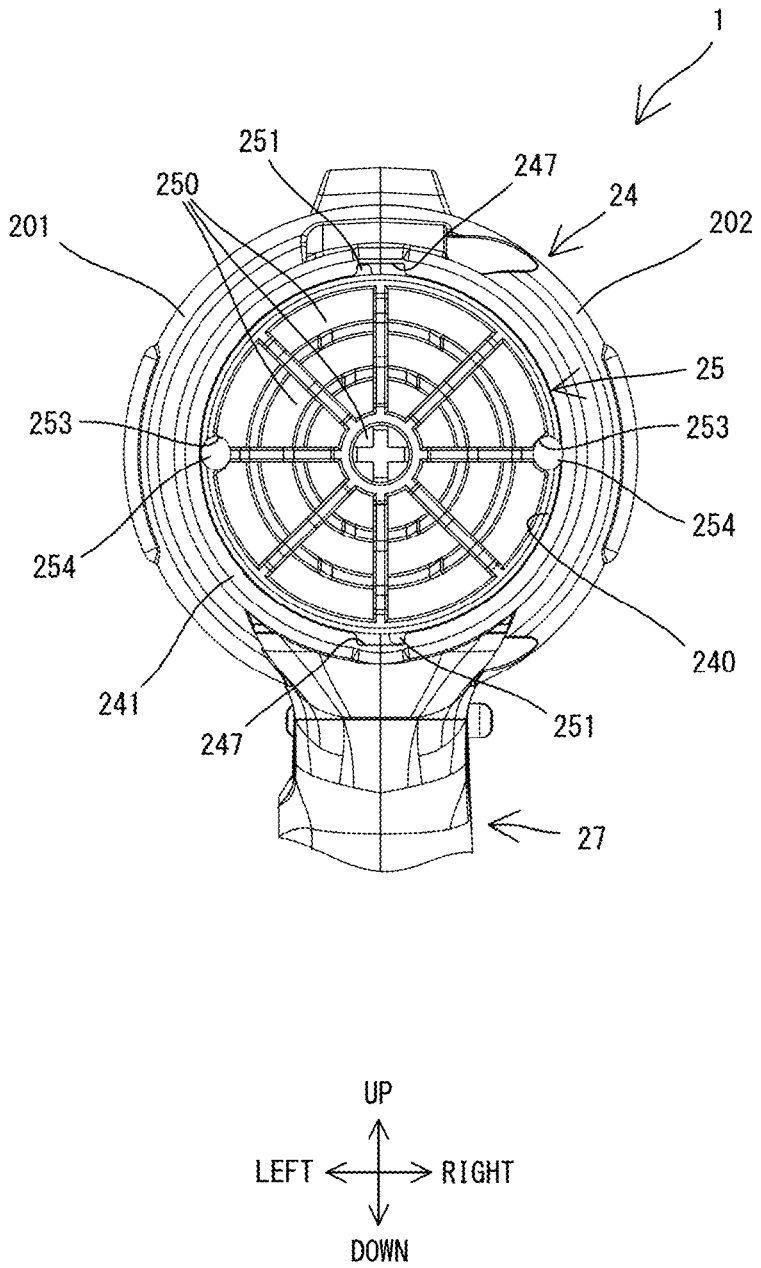
FIG. 3 is a partial, rear view of the air duster.

In this embodiment, as also shown in FIG. 3, inlet openings 250, through which air is sucked into the body 20, are formed at one end of the body 20 in an extension direction of a rotational axis A1 of a motor shaft 335 (hereinafter simply referred to as a rotational-axis-A1 direction). A nozzle 8 is mounted on the other end of the body 20 in the rotational-axis-A1 direction. An opening 80 at a tip end of the nozzle 8 defines the discharge opening 10, through which compressed air is discharged. The handle 27 is a portion to be held by the user and extends from the body 20 in a direction that intersects the rotational axis A1. The motor 33 and the fan 35 are arranged between the inlet openings 250 and the discharge opening 10 in the rotational-axis-A1 direction. Such arrangement of the inlet openings 250, the discharge opening 10 and the handle 27 realizes the air duster 1 that can be easily manipulated by the user holding the handle 27.

A trigger 281, which is configured to be manually depressed by the user, is disposed at a base end portion (an end portion connected to the body 20) of the handle 27. Further, a battery 295 is removably coupled to (mounted on) a protruding end portion (a distal end portion) of the handle 27. When the trigger 281 is depressed by the user, the motor 33 is energized and the fan 35 is rotationally driven, and thereby compressed air is discharged through the discharge opening 10.

The detailed structure of the air duster 1 is now described. In the following description, for the sake of convenience, the rotational-axis-A1 direction is defined as a front-rear direction of the air duster 1. In the front-rear direction, a direction from the inlet openings 250 toward the discharge opening 10 is defined as a forward direction, and an opposite direction thereof (a direction from the discharge opening 10 toward the inlet openings 250) is defined as a rearward direction. A direction that is orthogonal to the rotational-axis-A1 direction and that generally corresponds to the extension direction of the handle 27 is defined as an up-down direction of the air duster 1. In the up-down direction, a direction toward which the handle 27 protrudes from the body 20 (a direction from the body 20 toward the distal end portion of the handle 27) is defined as a downward direction, and an opposite direction thereof (a direction from the distal end portion of the handle 27 toward the body 20) is defined as an upward direction. A direction that is orthogonal to both the front-rear direction and the up-down direction is defined as a left-right direction of the air duster 1.

The handle 27 and elements/components disposed within the handle 27 are now described.

As shown in FIG. 1, the handle 27 is a hollow body that includes a tubular grip part 28 extending generally in the up-down direction and a rectangular box-like controller-housing part 29 connected to a lower end of the grip part 28. In this embodiment, the handle 27 is made of synthetic resin (polymeric material), and formed integrally with an outer shell 24 of the body 20, as described in detail later.

The grip part 28 is a portion to be held by the user when the air duster 1 is used (operated). The trigger 281 is provided at a front upper end portion of the grip part 28. A switch 283 is housed within the grip part 28. The switch 283 is normally kept OFF and turned ON in response to depressing of the trigger 281. The switch 283 is electrically connected to a controller 291 via wires (not shown). The switch 283 is configured to output to the controller 291 a signal corresponding to a manipulation amount (depressed amount) of the trigger 281 when the switch 283 is turned ON.

The controller-housing part 29 houses the controller 291. The controller 291 is configured to control various operations of the air duster 1, including driving of the motor 4. In this embodiment, the controller 291 is configured as a microcomputer that includes a CPU, a ROM, a RAM and a memory.

Further, a manipulation part 292, which is configured to be externally manipulated by the user, is provided on an upper portion of the controller-housing part 29. The manipulation part 292 is configured to accept various information inputs for setting the rotational speed of the motor 33 in response to the external manipulation of the user. Although not shown in detail, the manipulation part 292 of this embodiment has a push button switch. The manipulation part 292 is electrically connected to the controller 291 via wires (not shown) and configured to output to the controller 291 a specified signal in response to the manipulation of the push button switch. In this embodiment, the rotational speed of the motor 33 is settable at any one of four levels, in response to the depressed manipulation of the push button switch. Specifically, the rotational speed of the motor 33 can be selected from among 80,000 rotations per minute (rpm), 60,000 rpm, 40,000 rpm and 20,000 rpm. Thus, the maximum rotational speed of the motor 33 of this embodiment is 80,000 rpm.

The controller 291 is configured to control the rotational speed of the motor 33 steplessly according to the rotational speed selected by the user and the signal (i.e., the manipulation amount of the trigger 281) outputted from the switch 283. Specifically, the controller 291 multiplies the selected rotational speed by a rate that corresponds to the manipulation amount of the trigger 281, to thereby obtain a calculated rotational speed. The controller 291 controls the driving of the motor 33 such that the actual rotational speed of the motor 33 is equal to the calculated rotational speed.

A battery mounting part 294, which is configured to removably receive the rechargeable battery (also referred to as a battery pack) 295, is provided in (at) a lower end portion of the controller-housing part 29. The battery mounting part 294 includes a rail structure for sliding engagement with grooves of the battery 295, and terminals that are electrically connectable to terminals of the battery 295. The structures of the battery mounting part 294 and the battery 295 themselves are well known and therefore not described here.

Figure 2:
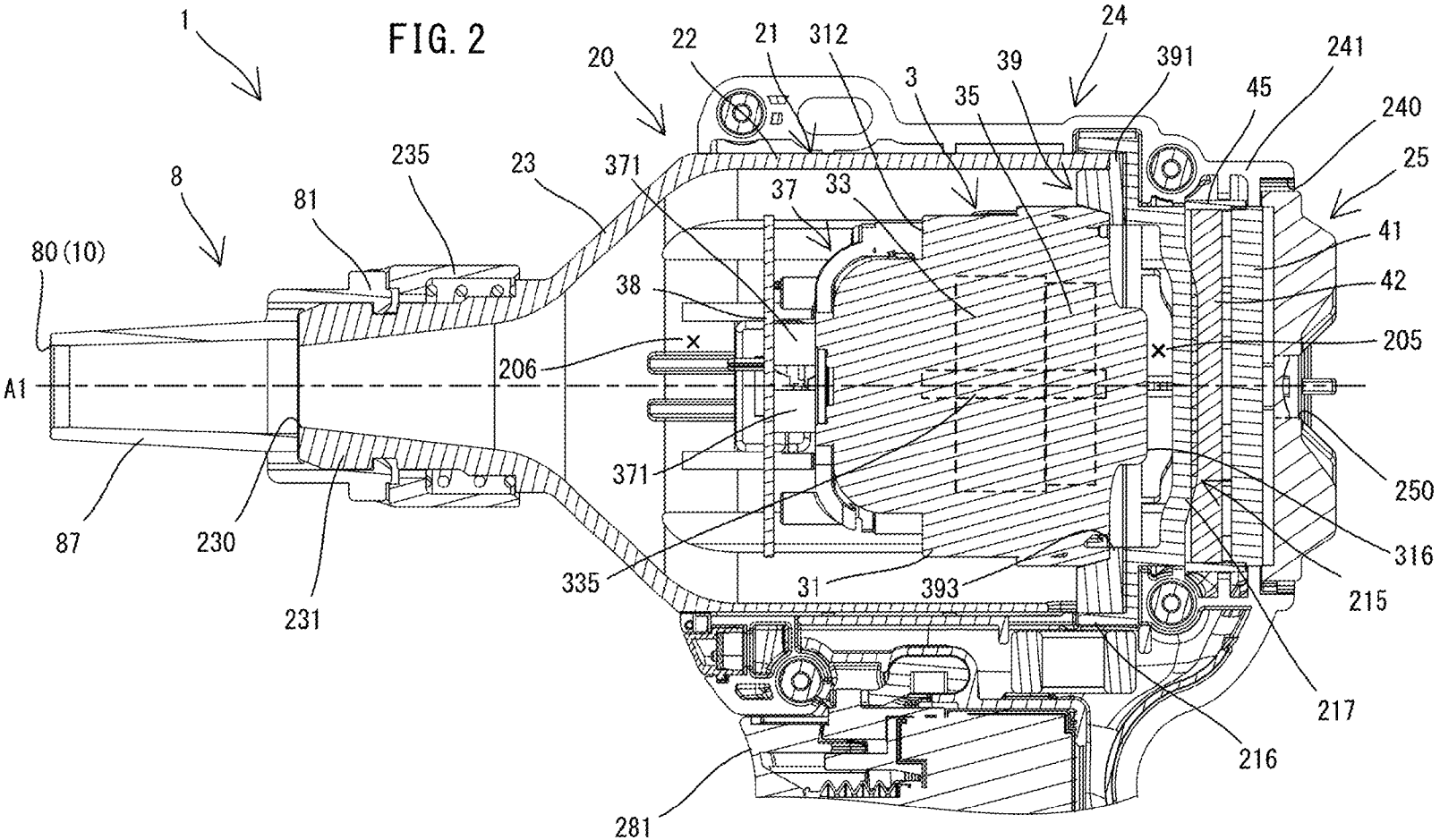
FIG. 2 is a partial, enlarged view of FIG. 1.
Figure 4:
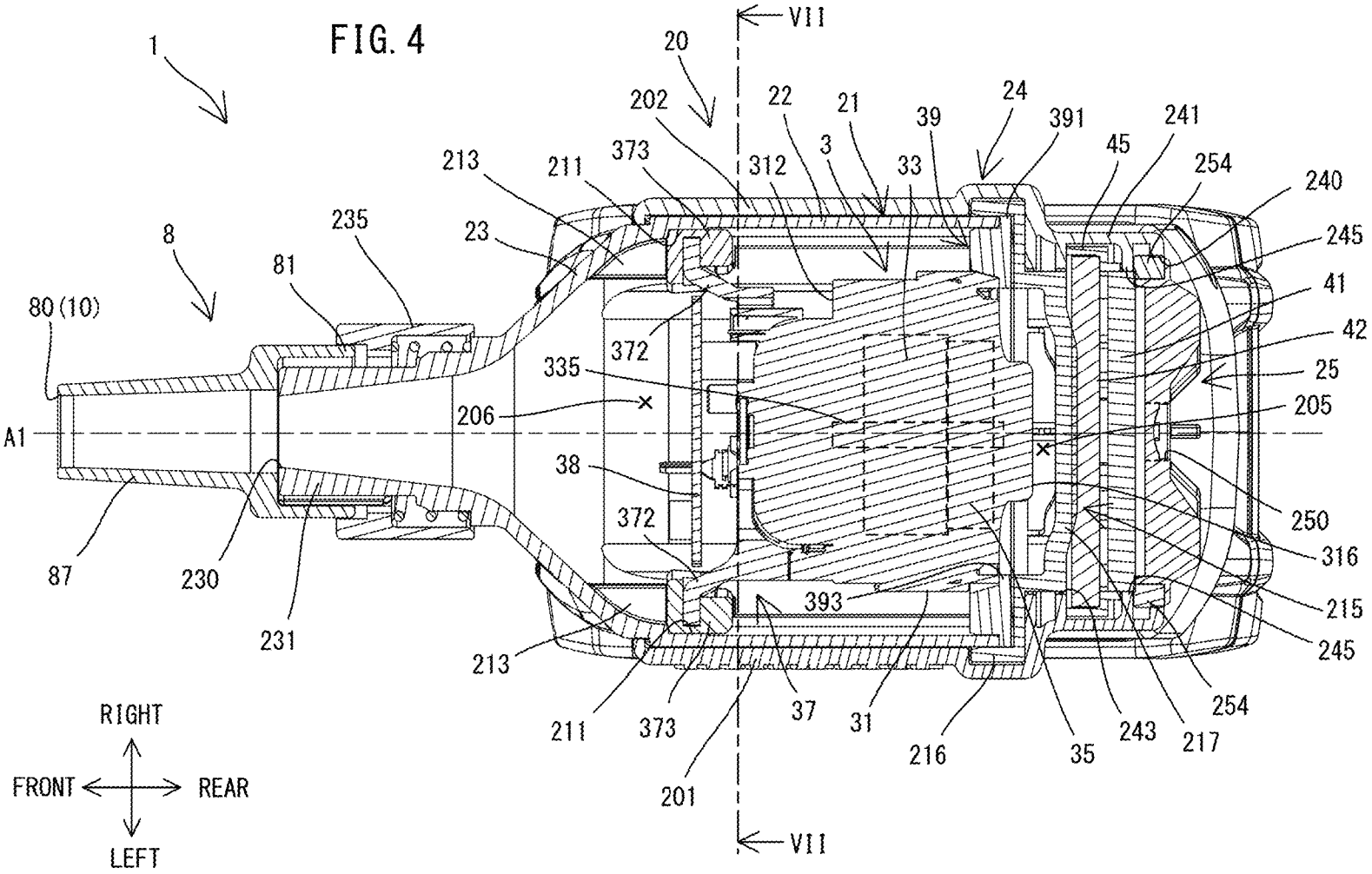
FIG. 4 is a sectional view taken along line IV-IV in FIG. 1.
Figure 5:
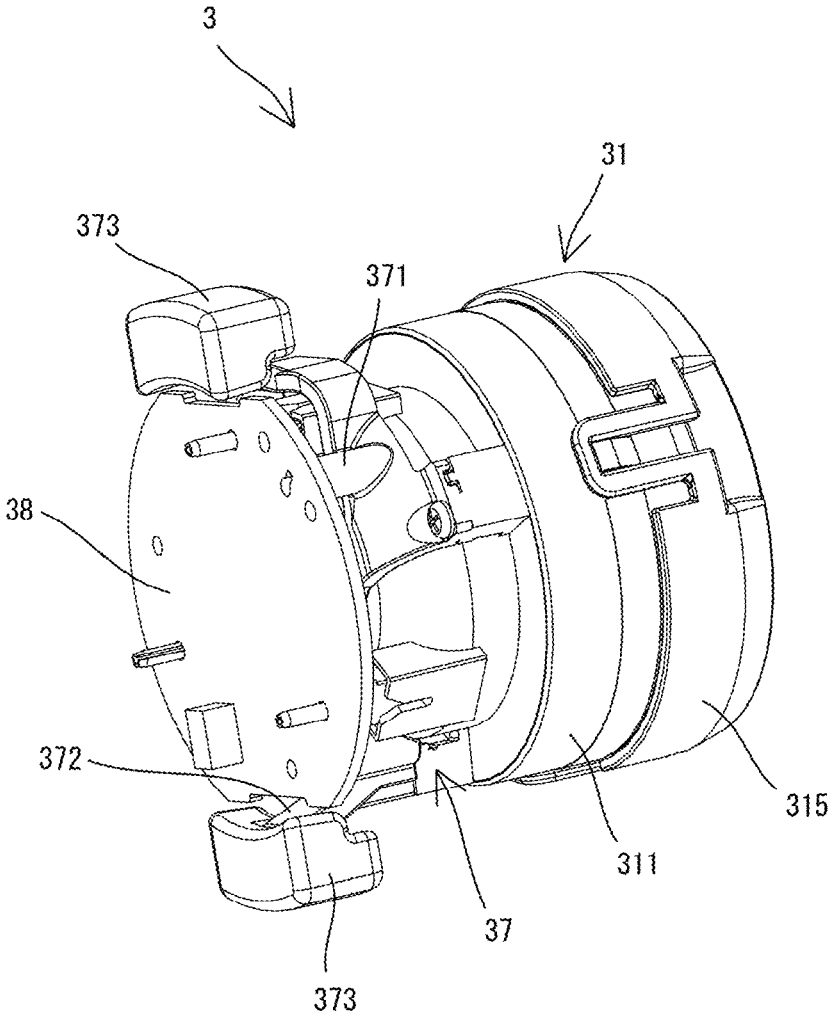
FIG. 5 is a perspective view of a motor assembly.

Next, the body 20 is described. As shown in FIGS. 2 to 4, the body 20 includes a tubular housing 21, the outer shell 24 and an inlet-side cover 25.

The tubular housing 21 includes a housing part 22 and a nozzle part 23. The housing part 22 is a portion of the tubular housing 21 within which the motor 33 and the fan 35 are disposed. The housing part 22 is configured as a hollow cylindrical body having a substantially uniform inner diameter and a substantially uniform outer diameter. The nozzle part 23 has a funnel shape as a whole and extends forward from a front end of the housing part 22. In this embodiment, in order to suppress leakage of the air from the housing part 22 and the nozzle part 23, the housing part 22 and the nozzle part 23 are formed integrally with each other (in a non-separable manner). However, the housing part 22 and the nozzle part 23 may be separate (discrete) members that are connected to each other.

A front end portion of the nozzle part 23 has a generally hollow cylindrical shape. The nozzle 8 is removably mounted on (coupled to, attached to) the front end portion of the nozzle part 23. More specifically, a locking mechanism 235, which is configured to lock the nozzle 8 to the body 20 at a specified mounting position, is disposed around the front end portion of the nozzle part 23. The nozzle 8 is mounted on the front end portion of the nozzle part 23 via the locking mechanism 235. Thus, the front end portion of the nozzle part 23 is also referred to as a nozzle mounting part 231. When the nozzle is not mounted on the nozzle mounting part 231, an opening 230 at the front end of the nozzle part 23 functions as the discharging opening 10 of the air duster 1. The air passes through the nozzle part 23 from a rear side to a front side thereof and then is discharged forward through the opening 230 (the discharge opening 10). The opening 230 of the nozzle part 23 has a circular shape of which a diameter is 13.0 millimeters (mm).

Although not described and shown in detail, the locking mechanism 235 of this embodiment has substantially the same structure as the locking mechanism disclosed in U.S. patent application Ser. No. 17/370,671 (the contents of which are incorporated herein by reference in its entirety) that was filed by the applicant of the present application. The locking mechanism 235 operates in response to manipulation by the user to move the nozzle 8 rearward relative to the air duster 1 and locks the nozzle 8 in the mounting position. Further, the locking mechanism 235 releases the locking of the nozzle 8 in response to manipulation by the user to rotate the nozzle 8 around its axis.

The nozzle 8 is now described. The nozzle 8 is an attachment configured to be additionally mounted on (coupled to, attached to) the air duster 1 for use with the air duster 1.

More specifically, the nozzle is a tubular body as a whole and has a through hole extending in its axial direction. The nozzle 8 of this embodiment includes a mounting part 81 and a passage part 87 that are coaxially connected to each other. The mounting part 81 is configured to be mounted on (coupled to, attached to) the body 20 (specifically, the locking mechanism 235) of the air duster 1. The passage part 87 is an elongate tubular body and extends in the axial direction of the nozzle 8 from one end of the mounting part 81. When the nozzle 8 is mounted on the body 20, the opening 80 at the tip end of the passage part 87 defines the discharge opening 10 of the air duster 1. When the nozzle 8 is mounted on the air duster 1, the compressed air flows into the passage part 87 through the opening 230 of the nozzle part 23, passes through the passage part 87 from the rear toward the front, and then is discharged forward through the opening 80 (the discharge opening 10) of the nozzle 8.

Various kinds of nozzles 8 are available for use with the air duster 1, aside from the nozzle 8 exemplarily described and shown in this embodiment. These nozzles 8 have different axial lengths and/or different diameters of the opening 80 (the discharge opening 10), respectively. The diameter of the discharge opening 10 is hereinafter also referred to as a nozzle diameter. More specifically, the nozzle diameter of the nozzle 8 of this embodiment is 12 mm, and the area of the opening 80 (the discharge opening 10) is 36π square millimeters ($mm^2$). In addition to the nozzle 8, various kinds of nozzles 8 having the different nozzle diameters within a range of 6 mm to 15 mm, respectively, are available. In other words, various kinds of nozzles 8 having the different areas of the opening 80 (the discharge opening 10) within a range of 9π $mm^2$ to 56.25π $mm^2$, respectively, are available. The user can use the air duster 1 without the nozzle 8 or with one of those nozzles 8 that is suitable for the kind of the operation to be performed using the air duster 1.

The outer shell 24 has a generally hollow cylindrical shape as a whole, and surrounds a portion (specifically, the housing part 22) of the tubular housing 21. A rear end portion of the outer shell 24 protrudes rearward of the tubular housing 21. Thus, a rear end portion of the housing part 22 is entirely within the outer shell 24. An opening 240 is formed at a rear end of the outer shell 24. The opening 240 is substantially circular as viewed from the rear. A portion (specifically, the nozzle part 23) of the tubular housing 21 protrudes forward from an open front end of the outer shell 24.

In this embodiment, the outer shell 24 is made of synthetic resin, and formed integrally with the handle 27. More specifically, a left portion of the outer shell 24 and a left portion of the handle 27 are integrated to form a left shell 201 (a left half). Similarly, a right portion of the outer shell 24 and a right portion of the handle 27 are integrated to form a right shell 202 (a right half). The left shell 201 and the right shell 202 are fixedly connected to each other in the left-right direction by screws, so that the outer shell 24 and the handle 27 are formed and the tubular housing 21 and the outer shell 24 are connected to each other in a substantially immovable manner relative to each other.

The inlet-side cover 25 is a cover member (a cap) that covers the opening 240 at the rear end of the outer shell 24 (specifically, a filter mounting part 241 described below). The inlet-side cover 25 is a substantially circular member and is fitted in the opening 240. An engagement structure of the inlet-side cover 25 and the body 20 will be described in detail later. Multiple inlet openings 250 are formed through the inlet-side cover 25 (see FIG. 3). When the fan 35 is rotated, the air is sucked from the outside into the body 20 through the inlet openings 250.

The elements/components disposed within the body 20 are now described.

As shown in FIG. 2, the motor 33, the fan 35 and two filters (a first filter 41 and a second filter 42) are disposed within the body 20. When the air duster 1 is viewed in a direction that is orthogonal to the rotational axis A1 (for example, viewed from the left side or the right side of the air duster 1), the inlet opening 250, the first filter 41, the second filter 42, the fan 35, the motor 33 and the discharge opening 10 are aligned (arranged) from the rear toward the front in this order on (along) a straight line extending in the front-rear direction.

Figure 6:
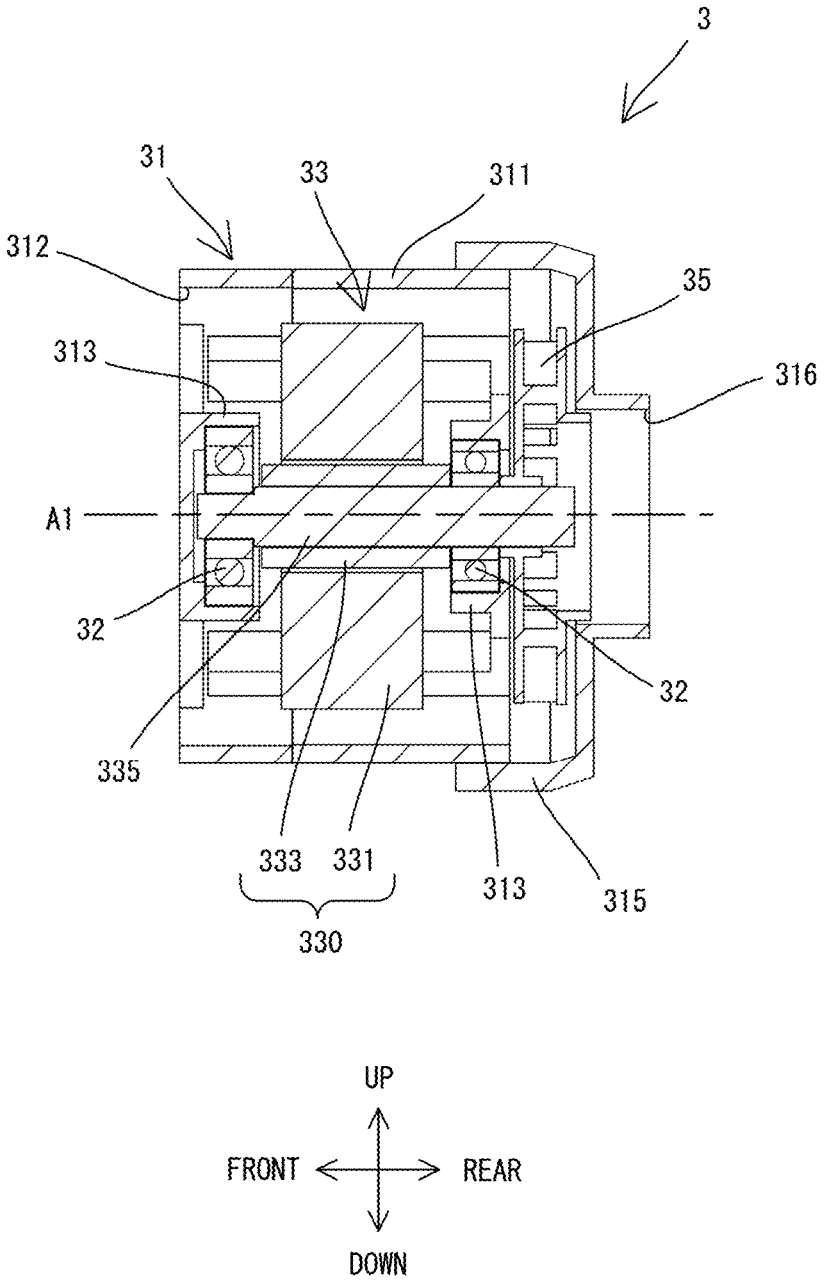
FIG. 6 is a sectional view of the motor assembly wherein a support member and a circuit board are not shown.

First, the motor 33 and the fan 35 are described. In this embodiment, the motor 33 and the fan 35 are integrated with related parts to form a motor assembly 3. The motor assembly 3 as one component (integrated unit) is supported in the body 20. More specifically, as shown in FIGS. 2, 4, 5 and 6, the motor assembly 3 includes a case 31, two bearings 32, the motor 33, the fan 35, a support member 37 and a circuit board 38. In FIG. 6, for the sake of convenience, the support member 37 and the circuit board 38 are not shown.

The case 31 is a hollow body that houses the motor 33 and the fan 35 and supports the bearings 32. The case 31 includes a peripheral wall 311, a cover 315 and two bearing support parts 313. The peripheral wall 311 is a cylindrical wall having an axis extending in the front-rear direction. The cover 315 has a short, bottomed cylindrical shape. The cover 315 is fitted and fixed to the peripheral wall 311 to cover an open rear end of the peripheral wall 311. A rear wall of the cover 315 is substantially orthogonal to the rotational axis A1. A circular first opening 316 is formed at a central portion of the rear wall of the cover 315 such that the inside (internal space) and the outside of the case 31 communicates each other. The bearing support parts 313 are respectively disposed in a front end portion and a rear end portion of the peripheral wall 311. The bearing support parts 313 are formed integrally with the peripheral wall 311. Each of the two bearings 32 (specifically, an outer ring of each ball bearing) is fitted in and supported by the bearing support part 313. A second opening 312 is formed between the peripheral wall 311 and the front bearing support part 313 such that the inside (internal space) and the outside of the case 31 communicates each other.

The motor 33 is an inner-rotor brushless motor. The motor 33 includes a motor body 330, which includes a stator 331 and a rotor 333, and the motor shaft 335. The stator 331 is fixedly supported within the case 31 by a plurality of ribs disposed on an inner peripheral surface of the peripheral wall 311 of the case 31. The rotor 333 and the motor shaft 335 are fixed with each other to be rotatable together. The motor shaft 335 is supported by the two bearings 32, which are supported by the bearing support parts 313 of the case 31 in front of and behind the rotor 333, so as to be rotatable around the rotational axis A1. A rear end portion of the motor shaft 335 is disposed in the cover 315.

Only one (single) fan 35 is fixed to the rear end portion of the motor shaft 335 (the end portion arranged in the cover 315). The fan 35 is a centrifugal fan that sucks air from the rear in the rotational-axis-A1 direction and feeds (delivers) the air radially outward. In this embodiment, the diameter of the fan 35 is 43 mm. The thickness of the fan 35 in the rotational-axis-A1 direction is 6 mm. By employing the single fan 35 that is relatively small, the body 20 can be made relatively small in the rotational-axis-A1 direction and the radial direction of the fan 35.

The fan 35 is arranged such that a central portion of the fan 35 on its suction side faces the first opening 316 of the cover 315. When the fan 35 is rotated, air is sucked into the case 31 through the first opening 316 of the rear end portion (the cover 315) of the case 31. The air is fed radially outward of the fan 35, cools the motor 33 while flowing around the stator 331 and between the stator 331 and the rotor 333 in the rotational-axis-A1 direction, and flows out of the case 31 through the second opening 312 of the front end portion of the case 31. Thus, the first opening 316 in the rear end portion (the cover 315) of the case 31 functions as an inlet opening that directs air into the case 31. The second opening 312 of the front end portion of the case 31 functions as a discharge opening that discharges the air out of the case 31.

The support member 37 is fixed to the front end portion of the case 31. The support member 37 includes a first arm 371 extending forward of the case 31, and two second arms 372 each extending forward and radially outward of the case 31.

The first arm 371 supports the circuit board 38. The circuit board 38 has a generally circular shape and the substantially same diameter as the outer diameter of the case 31. The circuit board 38 is supported at a position spaced apart forward from the case 31 and extends generally orthogonally to the rotational axis A1. A control circuit etc. are mounted on the circuit board 38. The control circuit is configured to control energizing to a coil of the stator 331 in response to a control signal from the controller 291. The circuit board 38 is electrically connected to the controller 291 and the stator 331 via wires (not shown). The two second arms 372 are arranged to face each other across the rotational axis A1. Each of the second arms 372 extends to a position substantially the same as that of the circuit board 38 in the front-rear direction and extends radially outward of the circuit board 38. A distal end portion of the second arm 372 is covered with an elastic cover 373 formed of an elastic body. In this embodiment, the elastic cover 373 is made of silicone rubber. However, the elastic cover 373 may be made of any elastic material other than silicone rubber (for example, rubber or other kinds of elastomer).

The structures for supporting the motor assembly 3 are now described.

As shown in FIGS. 2 and 4, the motor assembly 3 is housed in the tubular housing 21 (specifically, in the housing part 22) of the body 20. More specifically, the motor assembly 3 is elastically connected to and supported by the tubular housing 21 via the above-described elastic covers 373 mounted on (fitted on, around) the second arms 372 of the support member 37 and a seal ring 39 disposed between the tubular housing 21 and the case 31.

Figure 7:
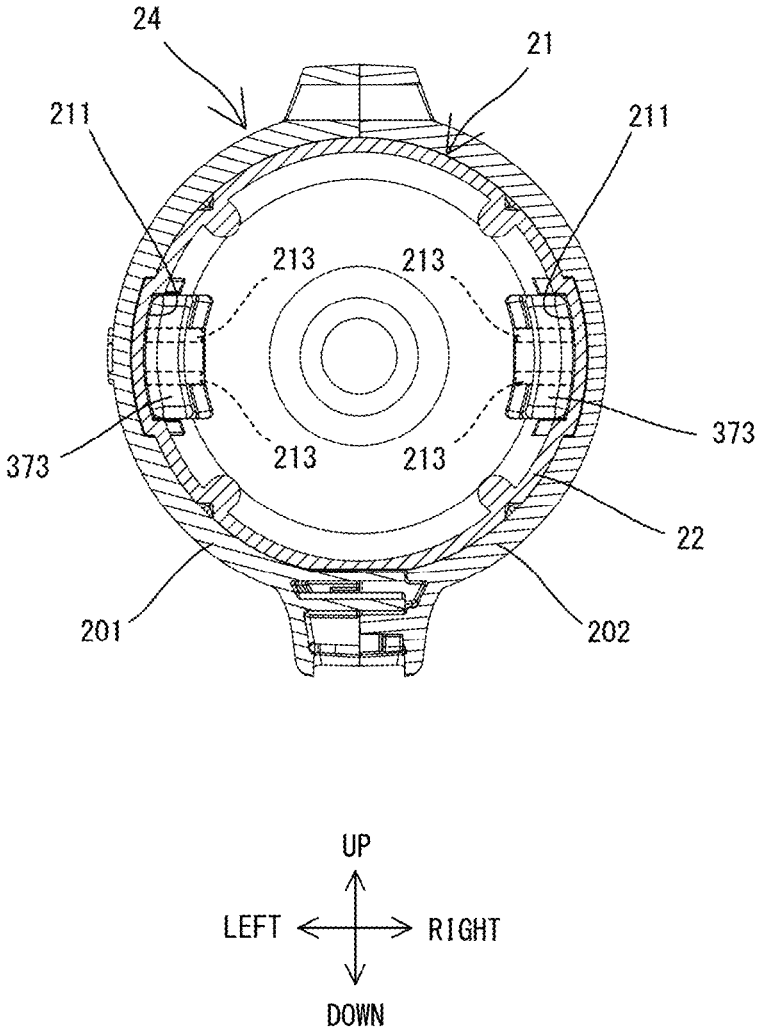
FIG. 7 is a sectional view taken along line VII-VII in FIG. 4 wherein the support member and the circuit board are not shown.

The elastic covers 373 mounted on the two second arms 372 of the support member 37 are supported while positioned relative to the tubular housing 21. More specifically, as shown in FIGS. 4 and 7, two recesses 211 are formed on the inner peripheral surface of the tubular housing 21. The recesses 211 are each recessed radially outward from the inner peripheral surface. The recesses 211 are formed on the inner peripheral surface in a left portion and a right portion of the tubular housing 21 (the housing part 22), respectively, so as to face each other across the rotational axis A1 (i.e., at diametrically opposite positions). Each of the recesses 211 extends in the front-rear direction. The elastic cover 373 is partially fitted in the recess 211. Four protruding pieces (ribs) 213 protrude radially inward from the inner peripheral surface in the front end portion of the tubular housing 21. Two of the four protruding pieces 213 are arranged in front of the left recess 211, and the other two of the protruding pieces 213 are arranged in front of the right recess 211.

The motor assembly 3 is disposed within the tubular housing 21 in a state in which the elastic covers 373 mounted on the two second arms 372 of the support member 37 are partially fitted in the recesses 211 from the rear side of the tubular housing 21. In the front-rear direction, the motor assembly 3 is positioned such that front ends of the elastic covers 373 abut on rear ends of the corresponding protruding pieces 213. Owing to engagement between the elastic covers 373 and the recesses 211, the motor assembly 3 is restricted from rotating around the rotational axis A1 relative to the tubular housing 21.

Figure 8:
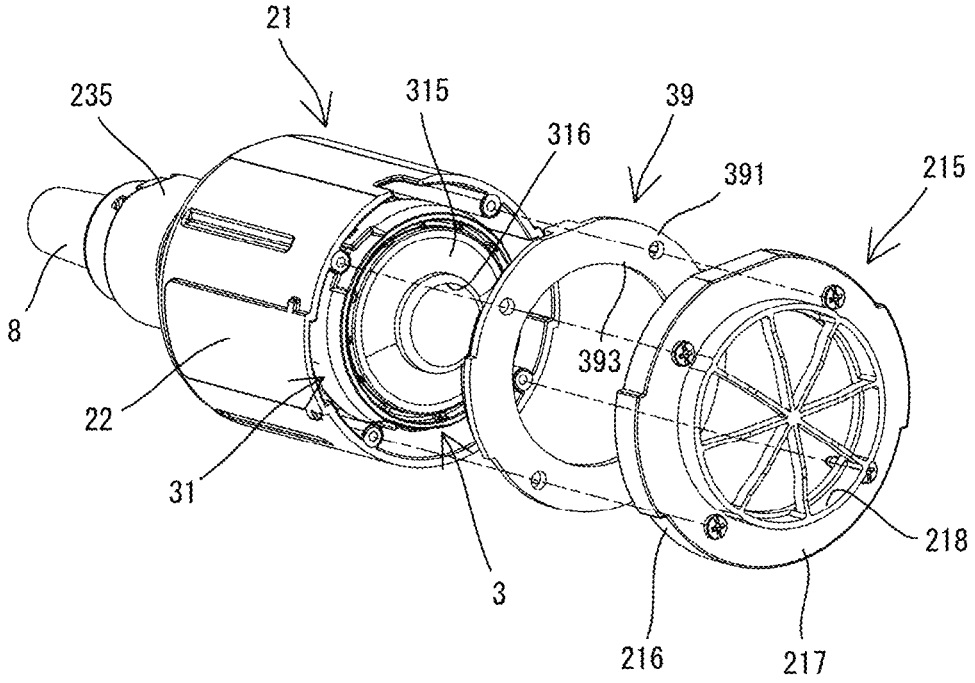
FIG. 8 is an exploded perspective view of a tubular housing, a seal ring and a fixing member.

As shown in FIGS. 2, 4 and 8, the seal ring 39 is an elastic body having a short, generally hollow cylindrical shape (or a generally ring (annular) shape) as a whole. In this embodiment, like the elastic cover 373, the seal ring 39 is made of silicone rubber. However, the seal ring 39 may be made of any elastic material other than silicone rubber (for example, rubber or other kinds of elastomer). An outer peripheral surface and an inner peripheral surface of the seal ring 39 are configured to substantially match (conform to) the inner peripheral surface of the rear end portion of the tubular housing 21 and the outer peripheral surface of the rear end portion of the case 31, respectively, when the seal ring 39 is slightly compressed. Further, a rear end portion of the seal ring 39 has an outer flange 391 that protrudes radially outward and an inner flange 393 that protrudes radially inward. The outer diameter of the outer flange 391 is substantially the same as the outer diameter of the tubular housing 21. The inner diameter of the inner flange 393 is smaller than the outer diameter of the cover 315 of the case 31.

The seal ring 39 is connected to the tubular housing 21 using a fixing member 215. The fixing member 215 includes a peripheral wall 216 to be fitted around the rear end portion of the tubular housing 21, and a pressing part 217 having substantially the same shape as a rear surface of the seal ring 39. Thus, the pressing part 217 has a generally ring (annular) shape and has an opening 218 at the center of the pressing part 217. A plurality of radial ribs (finger guards) are disposed in the opening 218 and connected to the pressing part 217. The opening 218 functions as a communication opening (an inlet opening of the tubular housing 21) that leads air, which has flowed into the outer shell 24 through the inlet opening 250 (see FIG. 3), into the tubular housing 21.

Each of the pressing part 217 of the fixing member 215 and the seal ring 39 has insertion holes for screws formed at intervals in the circumferential direction. Screws are inserted into the insertion holes of the pressing part 217 and the seal ring 39 from the rear side of the pressing part 217, and screwed into screw holes formed in the tubular housing 21, so that the seal ring 39 is pressed against the tubular housing 21 and the case 31 by the fixing member 215. Accordingly, the outer flange 391 and the inner flange 393 of the seal ring 39 are in close contact with a rear end surface of the tubular housing 21 and a rear surface of the rear wall of the cover 315, respectively. Further, a portion of the seal ring 39 other than the rear end portion is slightly compressed and fitted between the rear end portion of the case 31 (the cover 315) and the rear end portion of the tubular housing 21 in the radial direction, so that the portion of the seal ring 39 is in close contact with the outer peripheral surface of the case 31 and the inner peripheral surface of the tubular housing 21.

The tubular housing 21 is connected to the outer shell 24 in a state in which the motor assembly 3 is mounted in the tubular housing 21 and the seal ring 39 and the fixing member 215 are connected to the tubular housing 21 as described above. More specifically, the tubular housing 21 is positioned by the ribs (the protruding pieces) disposed on the inner peripheral surface of the outer shell 24 and held between the left shell 201 and the right shell 202 to be substantially immovable relative to the outer shell 24.

Owing to the structures and arrangements described above, as shown in FIGS. 2 and 4, the seal ring 39 partitions (separates) a space formed between the body 20 (the tubular housing 21, the outer shell 24 and the inlet-side cover 25) and the motor assembly 3 (specifically, the case 31), into (i) a first space 205 that communicates with the inlet opening 250 and the first opening 316 of the rear end portion of the case 31 and (ii) a second space 206 that communicates with the second opening 312 of the front end portion of the case 31 and the discharge opening 10. The first space 205 and the second space 206 may also be referred to as a suction-side space of the fan 35 and a discharge-side space of the fan 35, respectively. Further, in this embodiment, the first space 205 and the second space 206 may also be referred to as a rear-side space and a front-side space with respect to the seal ring 39, respectively. The seal ring 39 is configured to prevent air, which has flowed into the second space 206 through the second opening 312 at the front end portion of the case 31, from flowing into the first space 205. This structure (configuration) can suppress reduction of an air-blowing efficiency.

The second space 206 is a space formed within the tubular housing 21 and the air compressed by the fan 35 flows in the second space 206. In this embodiment, the second space 206 is formed within the tubular housing 21, which is a single (seamless) member, so that the air blown into the second space 206 is prevented from leaking out through a portion other than the discharge opening 10, and thus a pressure reduction in the second space 206 can be effectively suppressed.

In this embodiment, the seal ring 39 has a tubular shape (a ring (annular) shape) and the seal ring 39 can be partially fitted (inserted) between the inner peripheral surface of the tubular housing 21 and the outer peripheral surface of the case 31 in the radial direction, in close contact with the inner peripheral surface of the tubular housing 21 and the outer peripheral surface of the case 31. Thus, the first space 205 and the second space 206 can be easily and securely isolated from each other by the seal ring 39 having such a simple structure.

Further, as described above, in this embodiment, the inlet opening 250, the motor assembly 3 and the discharge opening 10 are aligned on (along) the same straight line as viewed in the direction that is orthogonal to the rotational axis A1 of the air duster 1 (for example, as viewed from the left side of the air duster 1). Owing to this configuration, an efficient air flow from the inlet opening 250 toward the discharge opening 10 via the motor assembly 3 can be generated.

As described above, in this embodiment, the circuit board 38 is arranged between the case 31 of the motor assembly 3 (specifically, the second opening 312 of the case 31) and the discharge opening 10. Thus, not only the motor body 330 (the stator 331 and the rotor 333) is cooled by the air flowing in the case 31, but also the circuit board 38 can be efficiently cooled by the air that has flowed out through the second opening 312 of the case 31. Further, the space formed between the inner peripheral surface of the tubular housing 21 and the motor assembly 3 in the radial direction can ensure that the air that has flowed out through the second opening 312 flows toward the discharge opening 10 without being blocked and interfered by the circuit board 38.

Further, in this embodiment, the motor assembly 3 is held by the seal ring 39 and the elastic covers 373 such that the motor assembly 3 is spaced apart from the inner peripheral surface of the tubular housing 21. Thus, the motor assembly 3 and the body 20 (the tubular housing 21) are elastically connected to each other via the seal ring 39 and the elastic covers 373. Accordingly, the motor assembly 3 and the body 20 are movable relative to each other in all directions. This configuration can effectively reduce vibration, which is caused by the driving of the motor 33, to be transmitted from the motor assembly 3 to the body 20 (the tubular housing 21) and thus to the outer shell 24 and the handle 27.

Further, in this embodiment, the seal ring 39 has a function of partitioning (isolating) the first space 205 and the second space 206 from each other and a function of reducing transmission of vibration from the motor assembly 3 to the body 21. Further, the elastic cover 373 has a function of positioning the motor assembly 3 relative to the body 20 and a function of reducing the transmission of the vibration from the motor assembly 3 to the body 21. Consequently, the air-blowing efficiency, the ease of assembling and the vibration-isolating performance can be improved without increasing the parts count.

The first filter 41, the second filter 42 and structures for supporting the first filter 41 and the second filter 42 are now described.

Figure 9:
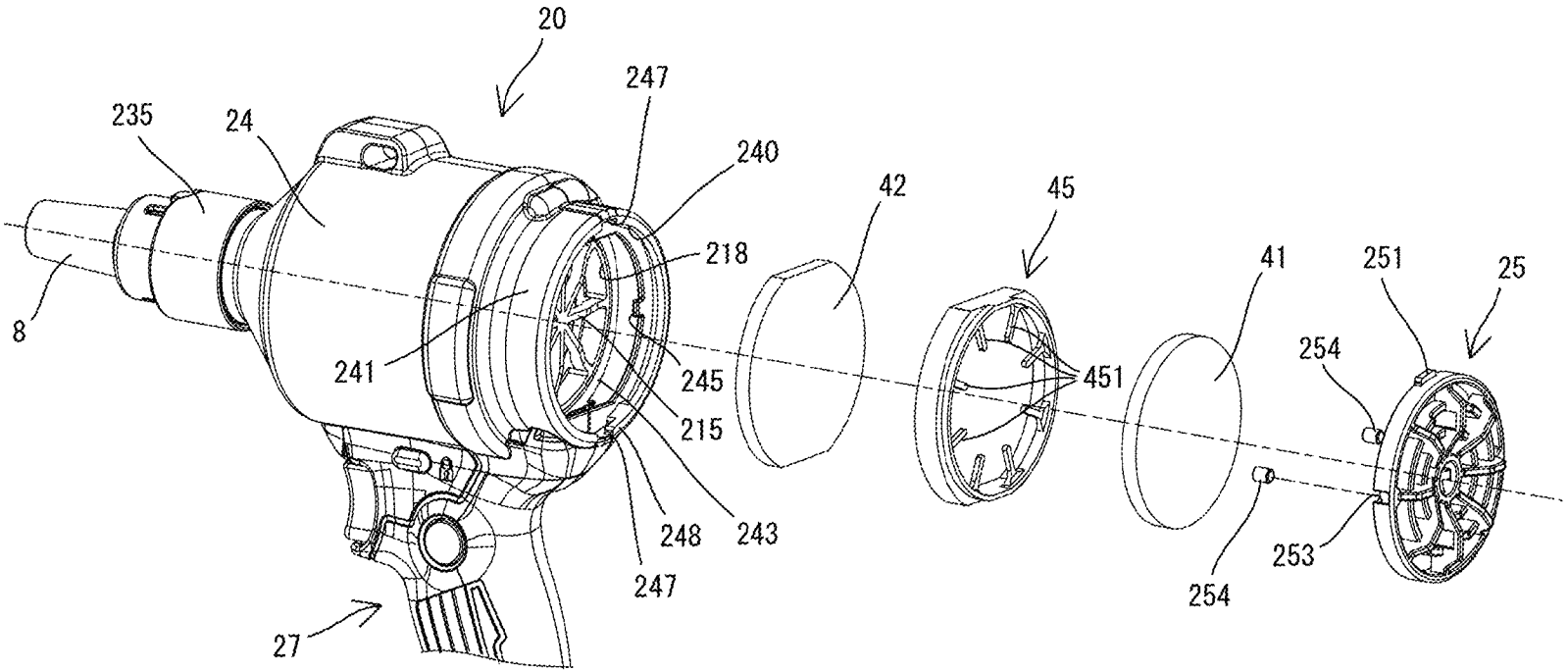
FIG. 9 is an exploded perspective view of a body, a second filter, a filter holder, a first filter and an inlet-side cover.

As shown in FIGS. 2, 4 and 9, the first filter 41 and the second filter 42 are arranged between the inlet-side cover 25 and the motor assembly 3, in the rear end portion of the body 20. The rear end portion of the body 20 (specifically, the rear end portion of the outer shell 24) is also referred to as a filter mounting part 241. In this embodiment, the filter mounting part 241 has a generally hollow cylindrical shape.

The second filter 42 is arranged in front of the first filter 41 (at the side of the motor assembly 3 relative to the first filter 41) in the filter mounting part 41. In this embodiment, the first filter 41 and the second filter 42 have different mesh sizes. More specifically, the mesh size of the second filter 42 is larger than that of the first filter 41. To put it differently, the second filter 42 permits a foreign matter having a larger size (for example, a particle having a larger diameter) to pass through the second filter 42 than the first filter 41. In this embodiment, a synthetic resin (polymeric) filter having an open cell foam structure is employed as each of the first filter 41 and the second filter 42. More specifically, the first filter 41 and second filter 42 are polyurethane sponges having different mesh sizes (cell sizes and arrangement of cells). The filter having the open cell foam structure can effectively capture foreign matters while suppressing reduction of the blowing force.

Each of the first filter 41 and the second filter 42 may be a filter having a structure other than an open cell foam structure, depending on a work environment in which the air duster 1 is mainly used. For example, a HEPA filter (High Efficiency Particulate Air filter), a powder filter or a non-woven fabric filter may be advantageously employed.

In this embodiment, the first filter 41 is mounted in (held in) the filter mounting part 241 such that the first filter 41 is easily removable from the outer shell 24. On the other hand, the second filter 42 is mounted in (held in) the outer shell 24 such that the second filter 42 is not easily removable from the filter mounting part 241.

More specifically, a filter holder 45 is disposed behind the above-described fixing member 215, and the second filter 42 is held between the fixing member 215 and the filter holder 45 in the front-rear direction. The filter holder 45 is a short tubular (cylindrical) member. A plurality of protrusions 451 protrude radially inward from an inner peripheral surface of a rear end portion of the filter holder 45. The length of each protrusion 451 is generally the half of the distance between the inner peripheral surface of the filter holder 45 and the center of the filter holder 45.

A flange 243 protrudes radially inward from the inner peripheral surface of the filter mounting part 241 behind the tubular housing 21. Two protrusions 245 are disposed at positions spaced apart rearward from the flange 243. The two protrusions 245 protrude radially inward from the inner peripheral surface of the filter mounting part 241 in a left portion and a right portion of the filter mounting part 241, respectively. The left shell 201 and the right shell 202 are connected together, with the second filter 42 and the filter holder 45 arranged between the flange 243 and the two protrusions 245 in the front-rear direction. The second filter 42 and the filter holder 45 are thus held by (in) the filter mounting part 241.

The second filter 42 covers the entirety of the opening 218 (communication opening) of the fixing member 215 fixed to the rear end portion of the tubular housing 21. The protrusions 451 of the filter holder 45 prevents the second filter 42 from being easily removed from the filter holder 45 and the body 20. More specifically, the protrusions 451 interfere with the outer peripheral portion of the second filter 42 to thereby restrict the second filter 42 from moving in a direction (a rearward direction) to be removed from the body 20. Thus, when the user removes the second filter 42 from the filter holder 45, the user needs to pinch a central portion of the second filter 42 (a portion not being pressed by the protrusions 451) and pull the second filter 42 out of the filter holder 45 with a certain level of force.

On the other hand, the first filter 41 is merely fitted in the filter mounting part 241, behind the protrusions 451 of the filter holder 45. The first filter 41 has the diameter slightly larger than the inner diameter of the filter mounting part 241. When the first filter 41 is fitted in the filter mounting part 241, the entirety of the outer peripheral surface (except for open cells) of the first filter 41 abuts on (contacts) the inner peripheral surface of the filter mounting part 241. The first filter 41 thus covers the entirety of the opening of the filter holder 45.

Figure 10:
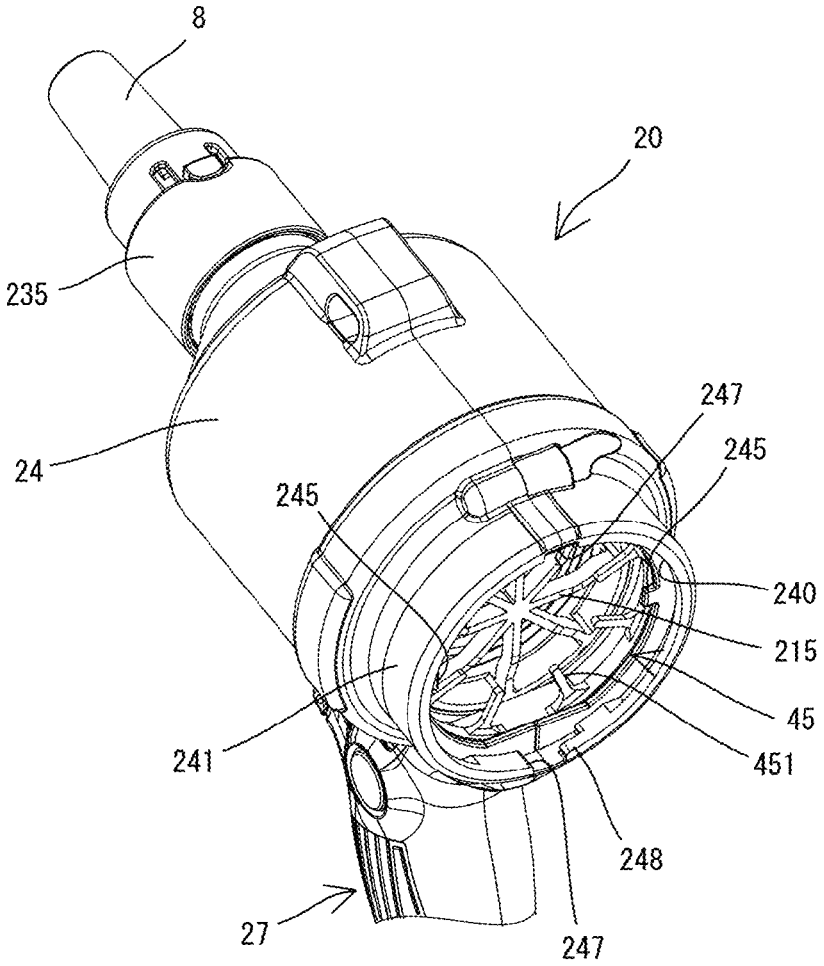
FIG. 10 is a perspective view of the body, from which the inlet-side cover has been removed.

The inlet-side cover 25 is removably mounted on the filter mounting part 241, behind the first filter 41. More specifically, as shown in FIGS. 9 and 10, engagement grooves 147 are formed on the inner peripheral surface of the filter mounting part 241 at an upper rear end portion and at a lower rear end portion of the filter mounting part 241, respectively. Each of the engagement grooves 247 is L-shaped and includes a first portion that extends forward from the rear end of the outer shell 24 and a second portion that extends in the circumferential direction of the filter mounting part 241 from a front end portion of the first portion. Thus, there is a wall portion 248 at the rear side of the second portion of each groove 247.

Two protrusions 251 protrude radially outward from an outer peripheral surface of the inlet-side cover 25. Further, two recesses 253 are formed on (in) the outer peripheral surface of the inlet-side cover 25. A cylindrical elastic pin 254 is fitted in and held in each of the recesses 253. The elastic pin 254 slightly protrudes radially outward on the inlet-side cover 25. In this embodiment, the elastic pin 254 is made of rubber (namely, the elastic pin 254 is a rubber pin). However, the elastic pin 254 may be made of other elastic material (for example, synthetic resin).

When mounting the inlet-side cover 25 on the filter mounting part 241, the user moves the inlet-side cover 25 forward relative to the filter mounting part 241 such that the protrusions 251 respectively enter the first portions of the engagement grooves 247 from behind. Thereafter, the user rotates the inlet-side cover 25 such that the protrusions 251 respectively move in the circumferential direction within the second portions. Accordingly, the protrusions 251 are respectively disposed in front of the wall portions 248. Each of the wall portions 248 abuts on the rear surface of the corresponding protrusion 251 to thereby block rearward movement of the inlet-side cover 25. Further, the elastic pins 254 each abut on the inner peripheral surface of the filter mounting part 241 to cause frictional resistance, so that the elastic pins 254 restrict rotation of the inlet-side cover 25 relative to the outer shell 24. Thus, the elastic pins 254 can reduce the likelihood that the inlet-side cover 25 drops off from the filter mounting part 241.

On the other hand, the user can easily remove the inlet-side cover 25 from the filter mounting part 241, by moving the inlet-side cover 25 relative to the filter mounting part 241 in a direction opposite to the direction in mounting the inlet-side cover 25. As described above, since the first filter 41 is simply fitted in the filter mounting part 241, the user can easily remove the first filter 41 from the outer shell 24 after removing the inlet-side cover 25.

As described above, in the air duster 1 of this embodiment, the air flow generated by the fan 35 enters the body 20 through the inlet openings 250, and passes and cools the motor 33 before reaching the discharge opening 10. Thus, if foreign matters (for example, dust) enter the body 20 through the inlet openings 250, they may adversely affect the motor 33. To cope with this, in this embodiment, the first filter 41 and the second filter 42 can capture the foreign matters that have entered the body 20, between the inlet openings 250 and the motor 33 (specifically, the first opening 316 of the case 31). Thus, the first filter 41 and the second filter 42 can serve to protect the motor 33.

Since the first filter 41 is simply fitted in the filter mounting part 241, the user can easily remove the first filter 41 from the body 20 and clean or replace the first filter 41. This configuration can thus suppress reduction of the air-blowing efficiency, which may be caused when the first filter 41 is clogged. Further, in this embodiment, the second filter 42 is employed in addition to the first filter 41. Thus, even if the first filter 41 is removed, the second filter 42 can capture the foreign matters before reaching the motor 33.

Further, in this embodiment, the mesh size of the second filter 42 is larger than that of the first filter 41. This is because the second filter 42 is more troublesome to be removed, and thus more difficult to be cleaned or replaced. It is thus preferable to employ a filter that is less likely to be clogged (i.e., a filter having a relatively large mesh size) as the second filter 42. On the other hand, since the first filter 41 is easily removable for its cleaning or replacement when the first filter 41 is clogged. Accordingly, it is preferable to employ a filter having superior capturing performance of the foreign matters (i.e. a filter having a relatively small mesh size) as the first filter 41. Thus, a rational structure can be realized for capturing the foreign matters in two stages.

The action modes of the air duster 1 are now described.

As described above, in this embodiment, the air duster 1 is configured to discharge the compressed air through the discharge opening 10 using the single fan 35. Thus, compared to a multiple-stage blower including a plurality of fans, the body 20 can be downsized in the rotational-axis-A1 direction. Further, by employing the single fan 35 having the maximum rotational speed of 80,000 rpm, which is relatively high, the air duster 1 can realize a relatively large blowing force and a relatively high dynamic pressure.

Further, the air duster 1 is configured such that the area of the discharge opening 10 is changeable. Specifically, the area of the discharge opening 10 can be changed, depending on whether the nozzle 8 is mounted on (coupled to, attached to) the air duster 1 and the kind of the nozzle 8 mounted on (coupled to, attached to) the air duster 1. More specifically, when the nozzle 8 is not mounted on the air duster 1, the area of the discharge opening 10 is the area of the opening 230 of the nozzle part 23 of the body 20 (i.e., the area of the circle having a diameter of 13 mm (42.25π $mm^2$)). When the nozzle 8 is mounted on the air duster 1, the area of the discharge opening 10 is the area of the opening 80 of the nozzle 8 mounted on the air duster 1. The area of the opening 80 of the nozzle 8 is selectable from the range of the area of the circle having the diameter of 6 mm to the area of the circle having the diameter of 15 mm (9π $mm^2$ to 56.25π $mm^2$). This range is rational as the area of the discharge opening 10 that can realize a first mode or a second mode while suppressing a possibility of the surging.

The air duster 1 is configured to selectively operate in the first mode or in the second mode, according to (depending on) the area of the discharge opening 10. The first mode is an action mode that focuses on the blowing force rather than the blowing pressure. In the first mode, when the motor 33 is driven at the maximum rotational speed, the maximum blowing force of the air discharged through the discharge opening 10 is within a range of 3.0 newtons (N) to 4.0 N. It is noted that the blowing force herein is measured in accordance with "ANSI B175.2 standard" specified by American National Standards Institute (ANSI). The second mode is an action mode that focuses on the blowing pressure rather than the blowing force. In the second mode, when the motor 33 is driven at the maximum rotational speed, the maximum dynamic pressure of the air discharged through the discharge opening 10 is within a range of 35 kPa to 50 KPa.

In this embodiment, when the area of the discharge opening 10 is within a range of the area of a circle having a diameter of 12 mm to the area of a circle having a diameter of 15 mm (i.e. when the nozzle diameter is in a range of 12 mm to 15 mm), the air duster 1 operates in the first mode. For example, in a case in which the nozzle 8 is not mounted and thus the opening 230 of the nozzle part 23 of the body 20 functions as the discharge opening 10 (i.e., the area of the discharge opening 10 is equal to the area of a circle having a diameter of 13 mm (1697 $mm^2$)), the maximum blowing force of the air to be discharged when the motor 33 is driven at the maximum rotational speed of 80,000 rpm, is approximately 3.2 N.

On the other hand, when the area of the discharge opening 10 is within a range of the area of a circle having a diameter of 6 mm to the area of a circle having a diameter of 8 mm (i.e., when the nozzle diameter is within a range of 6 mm to 8 mm), the air duster 1 operates in the second mode. For example, in a case in which the nozzle 8 having the nozzle diameter of 7 mm is mounted (i.e., the area of the discharge opening 10 is equal to the area of a circle having a diameter of 7 mm (49π $mm^2$)), the maximum dynamic pressure of the air to be discharged when the motor 33 is driven at the maximum rotational speed of 80,000 rpm, is approximately 42 kPa.

According to the air duster 1 of this embodiment, the user can use the air duster 1 in an appropriate action mode by mounting/removing or replacing the nozzle 8 to change the area of the discharge opening 10, depending on the kind of the desired operation, so that the usability of the air duster 1 is improved. Specifically, for example, in an operation to blow off a substance with a relatively large blowing force, like that generated by a general blower, the user can mount the nozzle having the nozzle diameter of 12 mm to 15 mm to the body 20 or remove the nozzle 8, so that the air duster 1 operates in the first mode. On the other hand, for example, in an operation to blow high-pressure air to an extremely small area, such as when removing dust stuck at one point of the filter, the user can mount the nozzle 8 having the nozzle diameter of 6 mm to 8 mm, so that the air duster 1 operates in the second mode.

Further, in this embodiment, the user can change the rotational speed of the motor shaft 335 by manipulating the manipulation part 292 and the trigger 281. Specifically, the user can select the rotational speed (specifically, the rotational speed that is used as a basis of the calculation for the actual rotational speed) from among four rotational speeds by manually depressing the manipulation part 292 (the push button switch). Further, the user can further change the rotational speed by changing the manipulation amount (the depressed amount) of the trigger 281. Thus, in either of the first mode and the second mode, the user can adjust the blowing force of the air to be discharged by manipulating the manipulation part 292 and the trigger 281, depending on the kind of the desired operation.

Correspondences between the features of the above-described embodiment and the features of the present disclosure or the invention are as follows. However, the features of the embodiment are merely exemplary, and do not limit the features of the present disclosure or the present invention.

The air duster 1 is an example of the "blower". The discharge opening 10 (the opening 230 or the opening 80) is an example of the "discharge opening". The body 20 is an example of the "body". The motor 33, the motor body 330, the stator 331, the rotor 333 and the motor shaft 335 are examples of the "motor", the "motor body", the "stator", the "rotor" and the "motor shaft", respectively. The fan 35 is an example of the "fan". The nozzle 8 is an example of the "nozzle". The circuit board 38 is an example of the "circuit board". The case 31 is an example of the "case". The motor assembly 3 is an example of the "motor assembly". The trigger 281 is an example of the "trigger".

The above-described embodiment is merely exemplary embodiments of the disclosure, and the blower according to the present disclosure is not limited to the air duster 1 of the above-described embodiment. For example, the following modifications may be made. Further, at least one of these modifications may be employed in combination with at least one of the air duster 1 of the above-described embodiment and the claimed features.

For example, the specifications of the air duster 1 of the above-described embodiment (the maximum rotational speed of the motor shaft 335, the maximum blowing force in the first mode, the maximum dynamic pressure in the second mode, the diameter of the fan 35, etc.) are merely exemplary, and thus any other values may be employed in the specifications. Exemplary possible modifications in the specifications are as follows.

The maximum rotational speed of the motor shaft 335 need not be 80,000 rpm. For example, the maximum rotational speed of the motor shaft 335 may be within a range of 50,000 rpm to 120,000 rpm, more preferably, within a range of 70,000 rpm to 90,000 rpm. In these ranges, it is more likely that the single fan 35, even though it has a relatively small diameter, generates a blowing force that is capable of blowing off larger substances (for example, wood debris, paper scraps, etc.), in addition to grit and dust, in the first mode.

The maximum blowing force in the first mode may be preferably within a range of, for example, 2.5 N to 5.0 N. In a case in which the maximum blowing force is within this range, the air duster 1 can blow off larger substances in addition to grit and dust. The maximum dynamic pressure in the second mode may be preferably within a range of, for example, 30 kPa to 65 kPa. In a case in which the maximum dynamic pressure is within this range, the air duster 1 can reliably blow off relatively small substances with high pressure.

The diameter of the fan 35 need not be 43 mm. However, it is preferable that the diameter of the fan 35 is within a range of 40 mm to 45 mm, considering a relationship between downsizing of the air duster 1 in the radial direction and securing of a sufficient blowing force.

In the above-described embodiment, the area of the discharge opening 10 can be changed by removing/mounting and replacing the nozzle 8. However, the area of the discharge opening 10 may be changed, for example, only by replacing the nozzle 8. In other words, the air duster 1 may be always used in a state in which a selected one of the available nozzles 8 is mounted to the body 20. The nozzle 8 and the body 20 may be connected (coupled) by any methods other than the locking mechanism 235 of the above-described embodiment. For example, the nozzle 8 and the body 20 may be connected to each other by threaded engagement between a female screw part formed in a proximal portion of the nozzle 8 and a male screw part formed on the body 20. Alternatively, the connection structure that is similar to that between the inlet-side cover 25 and the filter mounting part 241 of the above-described embodiment may be employed for connecting the nozzle 8 and the body 20.

The area of the discharge opening 10 may be changed by, for example, partially covering the opening 230 (the discharge opening 10) of the body 20. For example, the air duster 1 may include a cover (a shutter) that is linearly movable or pivotable to open and close at least a portion of the opening 230 (the discharge opening 10) in response to a manipulation of the cover performed by the user. Further, the shape of the discharge opening 10 may be appropriately changed to an oval shape, a polygonal shape, a star shape or the like, instead of the circular shape.

The structures (the shapes, components and connection structure between the components) of the body 20 and the handle 27 are not limited to those of the above-described embodiment and may be appropriately changed.

For example, the body 20 may be formed by only the tubular housing (and the fixing member 215). That is, the body 20 may be formed as a single housing member. Further, the tubular housing 21 may be formed by connecting two halves divided in a direction that is orthogonal to the rotational axis A1 (for example, in the left-right direction or the up-down direction) or by connecting a plurality of members divided in the front-rear direction.

The inlet-side cover 25 may be substantially irremovably connected to the outer shell 24 (the filter mounting part 241). Alternatively, the inlet-side cover 25 may be removably threadedly engaged with the outer shell 24, or may be removably connected to the outer shell 24 using separate screws. The size, shape, number and arrangement of the inlet openings 250 may be appropriately changed from those in the above-described embodiment.

A portion of the body 20 and the handle 27 need not be formed integrally with each other like the outer shell 24 of the above-described embodiment. Further, instead of the handle 27, a portion of the body 20 may include a grip part to be gripped by the user.

The motor 33 may be a brushed motor, instead of the brushless motor. The motor assembly 3 need not necessarily be supported by the body 20 (the tubular housing 21) via the elastic bodies. For example, the motor assembly 3 may be positioned and supported by a plurality of ribs disposed in the tubular housing 21. In addition, the motor 33 need not form an assembly together with the case 31, the bearings 32 and the fan 35, and the structure for supporting the motor 33 may be appropriately changed. For example, the case 31 that houses the motor body 330 may be omitted, and the motor shaft 335 may be rotatably supported by bearings supported by the body 20.

In the above-described embodiment, the rotational speed of the motor shaft 335 is changeable steplessly, in accordance with the manipulation amount of the trigger 281. However, the rotational speed of the motor shaft 335 may be set at a rotational speed selected via the manipulation part 292 and unchangeable from the set rotational speed. Alternatively, the rotational speed of the motor shaft 335 may be changeable only by the manual depressing of the trigger 281, or may be unchangeable. Further, the manipulation part 292 may include, for example, a dial or a touch screen, instead of the push button switch. The controller 291 may be formed by other kind of control circuit or circuitry, instead of the microcomputer.

The fan 35 may be fixed to the motor shaft 335 not at the same side with the inlet openings 250 relative to the motor body 330, but at the same side with the discharge opening 10 relative to the motor body 330. It is preferable that a centrifugal fan (in particular, a backward curved fan (also referred to as a turbo fan)) is employed as the fan 35. However, a mixed flow fan may be also employed.

At least one of the first filter 41 and the second filter 42 may be omitted. In a case in which only one filter is disposed, it is preferable that the filter is removable from the body 20.

The power source of the air duster 1 is not limited to the rechargeable battery 295, but may be a disposable battery or an external AC power source. A rechargeable battery may be incorporated in the air duster 1.

Further, in view of the nature of the present invention, the above-described embodiment and the modifications thereof, the following Aspects are provided. Any one or more of the following Aspects can be employed in combination with any one of the above-described embodiment and modifications, and the invention described in each claim.

(Aspect A1)

The area of the discharge opening is changeable by mounting/removing the nozzle to/from the body, and by replacing the nozzle.

(Aspect A2)

The discharge opening is defined by an opening in the body or the nozzle removably mounted to the body.

(Aspect A3)

The body has a first opening, the body is configured such that a nozzle having a second opening at a tip end thereof is selectively and removably mountable on the body in a state in which the first opening and the second opening communicate with each other, when the nozzle is not mounted on the body, the discharge opening is defined by the first opening, and when the nozzle is mounted on the body, the discharge opening is defined by the second opening.

The opening 230 of the nozzle mounting part 231 is an example of the "first opening". The opening 80 of the nozzle 8 is an example of the "second opening".

(Aspect A4)

The blower is configured to operate in the first mode when the area of the discharge opening is within a first range, and to operate in the second mode when the area of the discharge opening is within a second range, and the upper limit of the second range is smaller than the lower limit of the first range.

(Aspect A5)

The blower further comprises:

a manipulation part configured to be manipulated by a user for setting a rotational speed of the motor shaft, and a controller configured to control the rotational speed of the motor shaft in response to manipulation of the manipulation part.

The manipulation part 292 is an example of the "manipulation part". The trigger 281 is another example of the "manipulation part".

Further, in order to provide techniques for suppressing reduction of an air-blowing efficiency in the blower, the following Aspects B1 to B19 may be provided. Any one of the following Aspects B1 to B19 can be employed alone or two or more of them can be employed in combination with each other. Alternatively, any one of the following Aspects B1 to B19 can be employed in combination with any one of the air duster 1 of the above-described embodiment, the above-described modifications, the above-described Aspects A1 to A5 and the claimed features.

(Aspect B1)

A blower comprising:

a body having an inlet opening and a discharge opening;

a motor assembly housed in the body; and a seal member disposed between the body and the motor assembly, wherein:

the motor assembly comprises:

a case that has a first opening and a second opening;

a motor that includes a stator supported in the case, a rotor, and a motor shaft to be rotatable integrally with the rotor around a rotational axis that defines a front-rear direction of the blower;

a fan that is fixed to the motor shaft and is rotatable integrally with the motor shaft; and at least one bearing that is supported by the case and rotatably supports the motor shaft, and the seal member is configured to partition a space formed between the body and the motor assembly, into a first space communicating with the inlet opening and the first opening and a second space communicating with the second opening and the discharge opening.

In the blower of this Aspect, the case, the motor, the fan and the at least one bearing form the integral motor assembly. This configuration facilitates mounting of the motor assembly in the body. Further, the seal member is arranged between the body and the motor assembly and partitions the inner space of the body into the first space and the second space isolated from each other. Thus, the seal member can prevent air, which has flowed through the second opening of the case into the second space, from entering the first space. This configuration can suppress the reduction of the air-blowing efficiency.

(Aspect B2)

The blower as defined in Aspect B1, wherein the discharge opening is located frontward of the motor assembly in the front-rear direction, and configured to discharge air forward.

According to this Aspect, compared to a blower in which the discharge opening is located within a range of the motor assembly in the front-rear direction, the blower can be made compact in the radial direction. Further, the air flowing from the motor assembly toward the discharge opening can be efficiently discharged forward through the discharge opening.

(Aspect B3)

The blower as defined in Aspect B2, further comprising a handle that protrudes from the body and extends in a direction that intersects the rotational axis of the motor shaft, wherein the inlet opening is located rearward of the motor assembly in the front-rear direction such that the air flows forward through the inlet opening.

According to this Aspect, the inlet opening and the discharge opening are located rearward of and frontward of the motor assembly, respectively. Further, a flow direction of the air (a suction direction) that flows into the body through the inlet opening is the same with a flow direction of the air (a discharge direction) that is discharged from the body through the discharge opening. Thus, the air can efficiently flow from the inlet opening toward the discharge opening via the motor assembly. Further, since the handle extends in the direction that intersects the rotational axis of the motor shaft, the user can easily operate the air duster while holding the handle.

(Aspect B4)

The blower as defined in Aspect B3, wherein the inlet opening, the motor assembly and the discharge opening are aligned on a straight line as viewed in a direction that is orthogonal to the rotational axis of the motor shaft.

According to this Aspect, the air can efficiently flow from the inlet opening toward the discharge opening via the motor assembly.

(Aspect B5)

The blower as defined in any one of Aspects B1 to B4, further comprising at least one filter arranged between the inlet opening and the first opening.

According to this Aspect, the possibility can be effectively reduced that foreign matters (for example, dust) enter the motor assembly.

(Aspect B6)

The blower as defined in any one of Aspects B1 to B5, wherein at least a portion of the seal member is disposed between an inner surface of the body and an outer surface of the case in a radial direction relative the rotational axis and seals a gap between the inner surface of the body and the outer surface of the case.

According to this Aspect, the first space and the second space can be reliably isolated by the seal member.

(Aspect B7)

The blower as defined in any one of Aspects B1 to B6, wherein the body and the motor assembly are connected to be movable relative to each other by at least one elastic body disposed between the body and the motor assembly.

According to this Aspect, transmission of vibration from the motor assembly to the body can be reduced.

(Aspect B8)

The blower as defines in Aspect B7, wherein the seal member also serves as the at least one elastic body.

According to this Aspect, a function of reducing the transmission of the vibration from the motor assembly to the body can be obtained by utilizing the seal member that isolates the first space and the second space, without increasing parts count (the number of components).

(Aspect B9)

The blower as defined in Aspect B8, wherein:

the at least one elastic body includes a first elastic body disposed between a rear end portion of the motor assembly and the body, and a second elastic body disposed between a front end portion of the motor assembly and the body, and the seal member also serves as the first elastic body.

According to this Aspect, the transmission of the vibration from the motor assembly to the body can be further effectively reduced by an elastic connection structure including the elastic bodies.

(Aspect B10)

The blower as defined in Aspect B9, wherein the second elastic body is configured to restrict relative rotation between the motor assembly and the body in a circumferential direction around the rotational axis of the motor shaft.

According to this Aspect, the motor assembly can be held in an appropriate position relative to the body in the circumferential direction, utilizing the second elastic body.

(Aspect B11)

The first opening is formed at a rear end portion of the case, and the second opening is formed at a front end portion of the case.

(Aspect B12)

The rotational axis of the motor shaft intersects the first opening and the second opening (extends through the first opening and the second opening).

(Aspect B13)

The inlet opening is formed at a rear end portion of the body, and the discharge opening is formed at a front end portion of the body.

(Aspect B14)

The fan is configured to generate a flow of air that is sucked through the inlet opening, passes through the motor and is discharged through the discharge opening.

(Aspect B15)

The at least one filter is arranged within the first space.

(Aspect B16)

The at least one filter is removably mounted in (on) the body.

(Aspect B17)

The at least one filter includes a first filter and a second filter, and a mesh size of the second filter is larger than a mesh size of the first filter.

(Aspect B18)

The first filter is removably mounted in (on) the body, and the second filter is arranged between the first filter and the motor and mounted in (on) the body to be substantially irremovable from the body.

(Aspect B19)

The seal member is a single member having a tubular shape.

Correspondences between the features of the above-described embodiment and the features of the Aspects B1 to B19 are as follows. The features of the above-described embodiment are merely exemplary and do not limit the features of the Aspects B1 to B19.

The air duster 1 is an example of the "blower". The body 20 is an example of the "body". The inlet opening 250 is an example of the "inlet opening". The opening 230 of the body 20 is an example of the "discharge opening". The motor assembly 3 is an example of the "motor assembly". The seal ring 39 is an example of the "seal member". The case 31, the first opening 316 and the second opening 312 are examples of the "case", the "first opening" and the "second opening", respectively. The motor 33, the stator 331, the rotor 333 and the motor shaft 335 are examples of the "motor", the "stator", the "rotor" and the "motor shaft", respectively. The fan 35 is an example of the "fan". The bearing 32 is an example of the "bearing". The first space 205 and the second space 206 are examples of the "first space" and the "second space", respectively. The handle 27 is an example of the "handle". Each of the first filter 41 and the second filter 42 is an example of the "filter". Each of the seal ring 39 and the elastic cover 373 is an example of the "elastic body". The seal ring 39 is an example of the "first elastic body". The elastic cover 373 is an example of the "second elastic body".

The above-described embodiment is merely exemplary embodiments of the disclosure, and the blower according to the Aspect B1 to B19 is not limited to the air duster 1 of the above-described embodiment. For example, the following modifications may be made. Further, at least one of these modifications may be employed in combination with at least one of the air duster 1 of the above-described embodiment, the above-described modifications, the above-described Aspects and the claimed features.

For example, the specifications of the air duster 1 of the above-described embodiment (the maximum rotational speed of the motor shaft 335, the maximum blowing force in the first mode, the maximum dynamic pressure in the second mode, the area of the discharge opening 10, the diameter of the fan 35, etc.) are merely exemplary, and thus any other values may be employed in the specifications.

The structures (the shapes, components and connection structure between the components) of the body 20 and the handle 27 are not limited to those of the above-described embodiment and may be appropriately changed.

For example, the body 20 may be formed by only the tubular housing (and the fixing member 215). That is, the body 20 may be formed as a single housing member. Further, the tubular housing 21 may be formed by connecting two halves divided in a direction that is orthogonal to the rotational axis A1 (for example, in the left-right direction or the up-down direction) or by connecting a plurality of members divided in the front-rear direction. The inlet-side cover 25 may be substantially irremovably connected to the outer shell 24 (the filter mounting part 241). Alternatively, the inlet-side cover 25 may be removably threadedly engaged with the outer shell 24. For example, the inlet-side cover 25 may be removably connected to the outer shell 24 using separate screws. The size, shape, numbers and arrangement of the inlet opening 250 may be appropriately changed from those in the above-described embodiment.

A portion of the body 20 and the handle 27 need not be formed integrally with each other like the outer shell 24 of the above-described embodiment. Further, instead of the handle 27, a portion of the body 20 may include a grip part to be gripped by the user.

The structures of the motor assembly 3 may be appropriately changed. The motor 33 may be a brushed motor, instead of the brushless motor. The fan 35 may be fixed to the motor shaft 335 not at the same side with the inlet opening 250 relative to the motor body 330, but at the same side with the discharge opening 10 relative to the motor body 330 within the case 31. It is preferable that a centrifugal fan (in particular, a backward curved fan (also referred to as a turbo fan)) is employed as the fan 35. However, a mixed flow fan may be also employed. The arrangements of the first opening 316 and the second opening 312 of the case 31 may be appropriately changed in accordance with or regardless of the change relating to the fan 35. The support member 37 may be omitted in the motor assembly 3 and the circuit board 38 may be disposed at a position different from that in the above-described embodiment.

The motor assembly 3 need not necessarily be connected to the body 20 (the tubular housing 21) via the seal ring 39 and the elastic covers 373. For example, the motor assembly 3 may be supported by the seal ring 39 and a plurality of ribs disposed in the tubular housing 21. Alternatively, the motor assembly 3 may be supported by only the ribs disposed in the tubular housing 21. In this case, the seal ring 39 may have only one function of isolating the first space 205, which communicates with the inlet opening 250 and the first opening 316 of the case 10, and the second space, which communicates with the second opening 312 of the case 31 and the discharge opening 10. Thus, for example, instead of the single cylindrical seal ring 39, one or more elastic bodies that have the isolating function may be disposed between the body 20 and the case 31. The one or more elastic bodies may be preferably made of rubber or elastomer.

At least one of the first filter 41 and the second filter 42 may be omitted. In a case in which only one filter is disposed, it is preferable that the filter is removable from the body 20.

The power source of the air duster 1 is not limited to the rechargeable battery 295, but may be a disposable battery or an external AC power source. A rechargeable battery may be incorporated in the air duster 1.

Further, in order to provide techniques for effectively protecting the motor in the blower, the following Aspects C1 to C9 may be provided. Any one of the following Aspects C1 to C9 can be employed alone or two or more of them can be employed in combination with each other. Or alternatively, any one of the following Aspects C1 to C9 can be employed in combination with any one of the air duster 1 of the above-described embodiment, the above-described modifications, the above-described Aspects A1 to A5 and B1 to B19 and the claimed features.

(Aspect C1)

A blower comprising:

a body having an inlet opening and a discharge opening;

a motor housed in the body;

a fan housed in the body and is configured to rotate in response to driving of the motor to generate a flow of air that is sucked through the inlet opening, passes through the motor and is discharged through the discharge opening; and at least one filter arranged between the inlet opening and the motor within the body.

In the blower of this Aspect, the air is sucked through the inlet opening, passes through the motor and reaches the discharge opening, in response to rotation of the fan. The filter can capture foreign matters (for example, dust and grit), which enter the body through the inlet opening together with the air, between the inlet opening and the motor, so that the filter can protect the motor from the foreign matters.

(Aspect C2)

The blower as defined in Aspect C1, wherein the at least one filter is removably mounted in (on) the body.

According to this Aspect, since the filter can be removed from the body to be cleaned or replaced, the usability of the blower can be improved.

(Aspect C3)

The blower as defined in Aspect C2, wherein:

the body includes:

a filter mounting part that has an opening and that is configured such that the at least one filter is removably mounted therein; and a cover that removably covers the opening of the filter mounting part, and the at least one filter is removable from and mountable in the filter mounting part through the opening.

According to this Aspect, the user can remove and mount the at least one filter through the opening of the filter mounting part after removing the cover from the opening.

(Aspect C4)

The blower as defined in any one of Aspects C1 to C3, wherein:

the at least one filter includes a first filter and a second filter, and a mesh size of the second filter is larger than a mesh size of the first filter.

Here, "the mesh size of the second filter is larger" may be rephrased as "the second filter allows a foreign matter having a larger size (for example, a particle having a larger diameter) to pass therethrough". According to this Aspect, the foreign matters can be securely captured by two filters in two stages. Further, even in a case in which one of the two filters is removed, the other one can capture the foreign matters.

(Aspect C5)

The blower as defined in Aspect C4, wherein:

each of the first filter and the second filter is removably mounted in (on) the body, and the second filter is arranged between the first filter and the motor in a state in which movement of the second filter in a direction to be removed from the body is more restricted compared to the first filter.

In this Aspect, a filter having a superior capture performance of the foreign matters (i.e., having the smaller mesh size) is employed as the first filter that can be easily removed, and cleaned or replaced when the filter is clogged with the foreign matters, and a filter that is less likely to be clogged with the foreign matters (i.e. having the larger mesh size) is employed as the second filter that is not as easily removed as the first filter (i.e., cleaning or replacing thereof is not as easy). Thus, according to this Aspect, a rational structure can be realized for capturing the foreign matters in two stages.

(Aspect C6)

The blower as defined in any one of Aspects C1 to C5, wherein the at least one filter is formed by an open cell foam.

According to this Aspect, a filter can effectively capture the foreign matters while suppressing reduction of the blowing force.

(Aspect C7)

The blower as defined in any one of Aspects C1 to C6, wherein the at least one filter is a HEPA filter, a powder filter or a nonwoven fabric filter.

According to this Aspect, a filter can effectively capture the foreign mattes.

(Aspect C8)

The blower as defined in any one of Aspects C1 to C7, wherein the flow of air generated by the fan passes through the inlet opening, the at least one filter, the fan, the motor and the discharge opening in this order in an extension direction of a rotational axis of the fan.

According to this Aspect, an efficient air flow from the inlet opening toward the discharge opening is generated.

(Aspect C9)

The blower as defined in any one of Aspects C1 to C8, further comprising a restricting member that is at least partially arranged between the first filter and the second filter and that is configured to restrict movement of the second filter toward the opening of the filter mounting part.

Correspondences between the features of the above-described embodiment and the features of the Aspects C1 to C9 are as follows. The features of the above-described embodiment are merely exemplary and do not limit the features of the Aspects C1 to C9.

The air duster 1 is an example of the "blower". The body 20 is an example of the "body". The inlet opening 250 is an example of the "inlet opening". The opening 230 of the body 20 is an example of the "discharge opening". The motor 33 is an example of the "motor". The fan 35 is an example of the "fan". Each of the first filter 41 and the second filter 42 is an example of the "filter". The first filter 41 and the second filter 42 are examples of the "first filter" and the "second filter", respectively. The filter mounting part 241 and the opening 240 are examples of the "filter mounting part" and the "opening", respectively. The inlet-side cover 25 is an example of the "cover". The filter holder 45 is an example of the "restricting member".

The above-described embodiment is merely exemplary embodiments of the disclosure, and the blower according to the Aspect C1 to C9 is not limited to the air duster 1 of the above-described embodiment. For example, the following modifications may be made. Further, at least one of these modifications may be employed in combination with at least one of the air duster 1 of the above-described embodiment, the above-described modifications, the above-described Aspects and the claimed features.

For example, the specifications of the air duster 1 of the above-described embodiment (the maximum rotational speed of the motor shaft 335, the maximum blowing force in the first mode, the maximum dynamic pressure in the second mode, the area of the discharge opening 10, the diameter of the fan 35, etc.) are merely exemplary, and thus any setting thereof may be employed in the specifications.

The structures (the shapes, components and connection mode between the components) of the body 20 and the handle 27 are not limited to those of the above-described embodiment and may be appropriately changed.

For example, the body 20 may be formed by only the tubular housing (and the fixing member 215). That is, the body 20 may be formed as a single housing member. Further, the tubular housing 21 may be formed by connecting half bodies divided into a direction orthogonal to the rotational axis A1 (for example, the left-right direction of the up-down direction) or connecting a plurality of members divided in the front-rear direction. The inlet-side cover 25 may be removably screwed with the outer shell 24. For example, the inlet-side cover 25 may be removably connected to the outer shell 24 using screws separated provided. The size, shape, numbers and arrangement of the inlet opening 250 may be appropriately changed from those in the above-described embodiment.

A portion of the body 20 and the handle 27 need not be formed integrally with each other like the outer shell 24 of the above-described embodiment. Further, instead of the handle 27, a portion of the body 20 may include a grip part to be gripped by the user.

The motor 33 may be a brushed motor instead of the brushless motor. The motor assembly 3 need not necessarily be supported by the body 20 (the tubular housing 21) via the elastic body. For example, the motor assembly 3 may be positioned and supported by a plurality of ribs disposed in the tubular housing 21. In addition, the motor 33 need not form an assembly together with the case 31, the bearing 32 and the fan 35, and the structure for supporting the motor 33 may be appropriately changed. For example, the case 31 that houses the motor body 330 may be omitted, and the motor shaft 335 may be rotatably supported by a bearing supported by the body 20.

The fan 35 may be fixed to the motor shaft 335 not at the side of the inlet opening 250 relative to the motor body 330 but at the side of the discharge side relative to the motor body 330. A centrifugal fan (in particular, a backward curved fan (also called as a turbo fan)) is preferably employed as the fan 35, however a mixed flow fan may be also employed.

The structures, arrangements and holding structures of the first filter 41 and the second filter 42 may be appropriately changed. For example, the filter holder 45 may be omitted, and both of the first filter 41 and the second filter 42 may be easily removable from the body 20. In this case, for example, the first filter 41 that is disposed at the rear side (closer to the inlet opening 250) may employ a filter of which a mesh size is larger than that of a filter employed as the second filter 42 that is disposed at the front side (closer to the motor 33). In this case, the second filter 42 can capture fine foreign matters that have not been captured by the first filter 41. Alternatively, the mesh sizes of the first filter 41 and the second filter 42 may be substantially the same to each other.

At least one of the first filter 41 and the second filter 42 may be omitted. In a case in which only one filter is disposed, it is preferable that the filter is removable from the body 20. Further, for example, the filter may be removably mounted to the case 31 so as to cover the first opening 316 of the case 31 of the motor assembly 3.

The power source of the air duster 1 is not limited to the rechargeable battery 295, but may be a disposable battery or an external AC power source. A rechargeable battery may be incorporated in the air duster 1.

DESCRIPTION OF THE REFERENCE NUMERALS

1: air duster, 10: discharge opening, 20: body, 201: left shell, 202: right shell, 205: first space, 206: second space, 21: tubular housing, 211: recess, 213: protruding piece, 215: fixing member, 216: peripheral wall, 217: pressing part, 218: opening, 22: housing part, 23: nozzle part, 230: opening, 231: nozzle mounting part, 235: locking mechanism, 24: outer shell, 240: opening, 241: filter mounting part, 243: flange, 245: protrusion, 247: engagement groove, 248: wall, 25: inlet-side cover, 250: inlet opening, 251: protrusion, 253: recess, 254: elastic pin, 27: handle, 28: grip part, 281: trigger, 283: switch, 29: controller-housing part, 291: controller, 292: manipulation part, 294: battery mounting part, 295: battery, 3: motor assembly, 31: case, 311: peripheral wall, 312: second opening, 313: bearing support part, 315: cover part, 316: first opening, 32: bearing, 33: motor, 330: motor body, 331: stator, 333: rotor, 335: motor shaft, 35: fan, 37: support member, 371: first arm, 372: second arm, 373: elastic cover, 38: circuit board, 39: seal ring, 391: outer flange, 393: inner flange, 41: first filter, 42: second filter, 45: filter holder, 451: protrusion, 8: nozzle, 80: opening, 81: mounting part, 87: passage part, A1: rotational axis

What is claimed is:

1. A blower comprising:

a body having an inlet opening and a discharge opening;

a motor housed in the body;

a fan housed in the body and is configured to rotate in response to driving of the motor to generate a flow of air that is sucked through the inlet opening, passes through the motor and is discharged through the discharge opening; and at least one removably mounted filter arranged between the inlet opening and the motor within the body;

wherein:

the body includes (i) a filter mounting part that has an opening and within which the at least one filter is removably mounted and (ii) a cover that removably surrounds the opening of the filter mounting part and that removably surrounds the filter mounting part in a direction from the inlet opening to the discharge opening; and the at least one filter is removable from and mountable within the filter mounting part through the opening.

2. The blower as defined in claim 1, wherein:

the at least one filter includes a first filter and a second filter; and a mesh size of the second filter is larger than a mesh size of the first filter.

3. The blower as defined in claim 2, wherein:

the first filter is removably mounted within the body; and the second filter is between the first filter and the motor.

4. The blower as defined in claim 3, wherein:

the second filter is removably mounted within the body, and the second filter is arranged such that movement of the second filter in a direction to be removed from the body is more restricted compared to the first filter.

5. The blower as defined in claim 1, wherein the at least one filter is formed by an open cell foam.

6. The blower as defined in claim 1, wherein the at least one filter is a HEPA filter, a powder filter or a nonwoven fabric filter.

7. The blower as defined in claim 1, wherein the flow of air generated by the fan passes through the inlet opening, the at least one filter, the fan, the motor and the discharge opening in this order in an extension direction of a rotational axis of the fan.

8. The blower as defined in claim 1, wherein the blower is an air duster that is configured to discharge compressed air for blowing off grit or dust through the discharge opening.

9. The blower as defined in claim 8, wherein:

the at least one filter includes a first filter and a second filter;

the first filter is removably mounted within the body;

the second filter is between the first filter and the motor; and a mesh size of the first filter is smaller than a mesh size of the second filter.

10. The blower as defined in claim 9, wherein:

the body includes (i) a tubular filter mounting part that has an opening and within which the at least one filter is removably mounted and (ii) a cover that removably covers the opening of the filter mounting part;

the first filter and the second filter are disposed within the filter mounting part and between the cover and the motor; and the first filter is removable from and mountable within the filter mounting part through the opening.

11. The blower as defined in claim 10, further comprising a restricting member that is (i) arranged between the first filter and the second filter within the filter mounting part and (ii) configured to restrict movement of the second filter toward the first filter.

* * * * *